US008335328B2

(12) United States Patent
Holzmann

(10) Patent No.: US 8,335,328 B2
(45) Date of Patent: Dec. 18, 2012

(54) PROGRAMMABLE INTEGRATED MICROPHONE INTERFACE CIRCUIT

(75) Inventor: Peter Holzmann, San Jose, CA (US)

(73) Assignee: Winbond Electronics Corporation, Hsin-Chu (TW)

( * ) Notice: Subject to any disclaimer, the term of this patent is extended or adjusted under 35 U.S.C. 154(b) by 1455 days.

(21) Appl. No.: 11/923,564

(22) Filed: Oct. 24, 2007

(65) Prior Publication Data

US 2009/0110213 A1 Apr. 30, 2009

(51) Int. Cl.
*H04R 3/00* (2006.01)

(52) U.S. Cl. ..... 381/122; 381/95

(58) Field of Classification Search ..... 381/122
See application file for complete search history.

(56) References Cited

U.S. PATENT DOCUMENTS 3,748,491 A * 7/1973 Barrigher et al. ..... 307/149
6,107,888 A * 8/2000 Price, Jr. ..... 330/301
6,229,273 B1 * 5/2001 Kelly et al. ..... 318/400.29
6,285,769 B1 * 9/2001 Edelson et al. ..... 381/95
2002/0071578 A1 * 6/2002 Van Der Zwan et al. ..... 381/111
2004/0239783 A1 * 12/2004 Imaizumi et al. ..... 348/255
2005/0052246 A1 * 3/2005 Visocchi ..... 330/308
2006/0147061 A1 * 7/2006 Niwa et al. ..... 381/113
2006/0147062 A1 * 7/2006 Niwa et al. ..... 381/113
2007/0146086 A1 * 6/2007 Frank ..... 331/107 A
2007/0279127 A1 * 12/2007 Lee ..... 330/10
2008/0219474 A1 * 9/2008 Deruginsky et al. ..... 381/111
2008/0226100 A1 * 9/2008 Oddoart et al. ..... 381/120
2008/0310655 A1 * 12/2008 Holzmann ..... 381/122

OTHER PUBLICATIONS

Baker et al., "A Low-Power High-PSSR Current-Mode Microphone Preamplifier", IEEE Journal of Solid-State Circuits, vol. 38, No. 10, Oct. 2003, pp. 1671-1678.

* cited by examiner

*Primary Examiner* — Steven Loke
*Assistant Examiner* — Igwe U Anya
(74) *Attorney, Agent, or Firm* — Kilpatrick Townsend & Stockton LLP

(57) ABSTRACT

An integrated circuit for providing programmable microphone interface includes an input terminal for receiving an input signal and an output terminal for providing an output audio signal. The integrated circuit includes a bias circuit, an amplifier circuit, and two feedback circuits. The bias circuit provides a microphone bias signal to the microphone and provides a sensed microphone signal. The amplifier circuit includes a first input, a second input, and an output. The first input is configured to receive the sensed microphone signal, a first feedback signal, and a second feedback signal. The second input is configured to receive a first reference signal. The feedback circuits are in communication with the output and the first input of the amplifier circuit. In a specific embodiment, the first feedback circuit includes an RC circuit and the second feedback circuit includes an integrator.

19 Claims, 12 Drawing Sheets

280

PROGRAMMABLE INTEGRATED MICROPHONE INTERFACE CIRCUIT

CROSS-REFERENCES TO RELATED APPLICATIONS

This application is related to co-pending U.S. patent application Ser. No. 11/761,957, filed Jun. 12, 2007, commonly assigned and incorporated by reference herein for all purposes.

BACKGROUND OF THE INVENTION

The present invention is directed to integrated circuits. More particularly, the invention provides a method and device for an integrated circuit for a microphone interface. Merely by way of example, the invention has been applied to interface circuit for an electret microphone. But it would be recognized that the invention has a much broader range of applicability. For example, the invention can be applied to interface circuits to other kinds of microphones or interface circuits to other signal sources.

Voice and audio band applications often use a microphone to pick up the voice or audio energy from the environment and translate it into a voltage or current. Microphones are used in many applications such as telephones, tape recorders, hearing aids, multimedia productions, computers for recording voice, voice control interface for computers, VoIP, and other computer applications. A popular choice for the microphone is the 'electret condenser' type microphone. This microphone typically requires a DC bias to operate. An example is shown in FIG. 1, which is a schematic diagram of a conventional CODEC microphone interface circuit. As shown, electret microphone 102 often requires many off-chip components to interface with a CODEC integrated circuit 150. For example, microphone 102 is biased with resistors 112 and 114, and a capacitor 122 for a DC bias with noise and power supply filter. A gain stage is often used to interface with the CODEC chip 150. In FIG. 1, the gain stage includes discreet components such as capacitors 142, 144, 146, and 148, and resistors 132, 134, 136, and 138. Even though conventional interface circuit techniques have been in wide use, they suffer from many limitations, as discussed in more details below.

Therefore, an improved technique for microphone interface circuit is desired.

BRIEF SUMMARY OF THE INVENTION

The present invention is directed to integrated circuits. More particularly, the invention provides a method and device for an integrated circuit for a microphone interface. Merely by way of example, the invention has been applied to interface circuit for an electret microphone. But it would be recognized that the invention has a much broader range of applicability. For example, the invention can be applied to interface circuits to other kinds of microphones or interface circuits to other signal sources.

According to an embodiment of the invention, an integrated circuit for microphone interface is provided. The integrated circuit includes an input terminal for receiving an input signal, an output terminal for providing an output signal, and a bias circuit. The bias circuit is coupled to the input terminal for providing a bias signal at the input terminal and is configured to provide a sensed input signal. The integrated circuit also includes a first amplifier circuit, which has a first input, a second input, and an output. The first input is configured to receive the sensed input signal, a first feedback signal, and a second feedback signal. The second input is configured to receive a first reference signal, and the output is configured to provide the output signal to the output terminal. The integrated circuit also includes two feedback circuits. The first feedback circuit is in communication with the output and the first input of the first amplifier circuit and provides the first feedback signal to the first input of the first amplifier circuit. The second feedback circuit is in communication with the output and the first input of the first amplifier circuit and provides the second feedback signal to the first input of the first amplifier circuit. The second feedback circuit further includes an integrator circuit.

In a specific embodiment of the integrated circuit, the input terminal is configured to receive an input signal from an electret microphone without requiring external components. In an embodiment, the bias circuit includes a reference circuit for providing a second reference signal, which can be a reference voltage or a reference current. The bias circuit includes a first input resistor in communication with the input terminal and the reference circuit, and a second input resistor in communication with the input terminal and the second input of the first amplifier circuit.

In certain embodiments, the first feedback circuit includes a first feedback resistor and a first feedback capacitor in a parallel configuration. In some embodiments, the integrator circuit includes an inverting amplifier coupled to the output of the first amplifier circuit and a second amplifier circuit. The second amplifier circuit includes a first input, a second input, and an output. The second input is coupled to a third reference signal. The first feedback circuit also includes a second feedback resistor coupled to an output of the unity gain inverting amplifier and the first input of the second amplifier circuit, and a second feedback capacitor coupled to the first input and the output of the second amplifier circuit. In an embodiment, the output of the second amplifier circuit is coupled to the second input of the first amplifier circuit through a third feedback resistor.

In some embodiment, the integrator circuit includes a switched capacitor circuit and a second amplifier circuit. The switched capacitor circuit includes a switch capacitor and a first, a second, a third, and a fourth switches. The first and second switches are coupled to a first terminal of the switch capacitor, whereas the third and fourth switches are couple to a second terminal of the switch capacitor. Additionally, the second and fourth switches are coupled to the first reference signal. The second amplifier circuit includes a first input, a second input, and an output. The first input is in communication with the third switch of the switched capacitor circuit. The second input is coupled to the first reference signal. The second amplifier circuit also includes a second feedback capacitor in communication with the first input and the output of the second amplifier circuit.

In an embodiment, the integrated circuit also includes a supply voltage. The first reference signal is about half of the supply voltage in magnitude for providing maximum signal swing allowed by the supply voltage at the output terminal. In certain embodiment, the integrated circuit is characterized by a DC loop gain, which is sufficiently large to cause a voltage at the output of the first amplifier to be substantially equal to the first reference voltage. In a specific example, the integrated microphone interface circuit is characterized by a DC loop gain ranging from about 80 dB to about 140 dB. In some embodiments, the integrated circuit is characterized by a large DC loop gain and low AC loop gain, causing a DC output voltage at the output terminal to be substantially equal to the first reference voltage, and an AC output voltage to be linearly proportional to the first feedback circuit's impedance and an AC input current or voltage through the input terminal. In another embodiment, the bias circuit provides a programmable voltage or current reference, and the first and the second feedback resistors are programmable.

According to another embodiment of the invention, an integrated circuit for providing a microphone interface includes a first input terminal and second input terminal for receiving a first and a second differential input signals, respectively. The integrated circuit also includes a first output terminal and second output terminal for providing a first and a second differential output signals, respectively. The integrated circuit further includes two bias circuits. A first bias circuit is in communication with the first input terminal and a first reference signal, and provides a first sensed input signal. A second bias circuit is in communication with the second input terminal and a second reference signal, and provides a second sensed input signal. The integrated circuit further includes a first amplifier circuit, which has a first, a second, and a third inputs. The first input receives the first sensed input signal, the second input receives a second sensed input signal, and the third input receives a common-mode reference signal. The first amplifier circuit also has a first and a second outputs. The first and second outputs provide the first and second differential output audio signals to the first and second output terminals, respectively. Additionally, the integrated circuit includes a feedback circuit, which is in communication with the first and second inputs and the first and the second outputs of the first amplifier circuit.

In a specific embodiment, the first and second input terminals are configured to receive input signals from an electret microphone. In an embodiment, the first bias circuit includes a third resistor in communication with the first input terminal and a microphone reference signal source and a fourth resistor in communication with the first input terminal and the third resistor, the fourth resistor providing the first sensed input signal. In an embodiment, the second bias circuit includes a fifth resistor in communication with the second input terminal and a ground reference voltage source, and a sixth resistor in communication with the second input terminal and the fifth resistor, the sixth resistor providing the second sensed input signal.

In some embodiments, the feedback circuit also includes three feedback circuits. The first feedback circuit communicates with the first output and the first input of the first amplifier. In a specific example, the first feedback circuit includes a first resistor and a first capacitor connected in parallel. The second feedback circuit communicates with the second output and the second input of the first amplifier. In an example, the second feedback circuit includes a second resistor and a second capacitor connected in parallel. In an embodiment, the third feedback circuit is a differential feedback circuit. The differential feedback circuit includes a first and a second inputs which are coupled, respectively, to the first and second outputs of the first amplifier circuit. The differential feedback circuit also includes a first and a second outputs which are coupled, respectively, to the first and second inputs of the first amplifier circuit.

In a specific embodiment, the differential feedback circuit further includes the following components. A differential amplifier includes a first, a second, and a third inputs and a first and a second outputs. The third input receives the common-mode reference signal. A first resistor is connected to the first input of the differential amplifier. A second resistor is connected to the first output of the differential amplifier. A first capacitor connects the first input and the first output of the differential amplifier. A third resistor is connected to the second input of the differential amplifier. A fourth resistor is connected to the second output of the differential amplifier. A second capacitor connects the second input and the second output of the differential amplifier. In an embodiment the integrated circuit also includes a supply voltage. The common-mode reference signal is about half of the supply voltage in magnitude for providing maximum signal swing allowed by the supply voltage at the output terminal.

According to an alternative embodiment of the present invention, an integrated circuit for a microphone interface includes an input terminal for receiving an input signal, an output terminal for providing an output signal, and a programmable reference circuit for providing a bias signal. The integrated circuit also includes a first amplifier circuit, which has a first input, a second input, and an output. The first input is configured to receive the bias signal, a first feedback signal, and a second feedback signal. The second input is configured to receive a first reference signal. The output is configured to provide the output signal to the output terminal. The integrated circuit further includes two feedback circuits. The first feedback circuit is in communication with the output and the first input of the first amplifier circuit, and provides the first feedback signal to the first input of the first amplifier circuit. The second feedback circuit is in communication with the output and the first input of the first amplifier circuit, and provides the second feedback signal to the first input of the first amplifier circuit. The second feedback circuit also includes an integrator circuit.

In a specific embodiment of the above integrated circuit, the input terminal is configured to receive an input signal from an electret microphone without requiring external components. In an embodiment, the bias circuit includes a reference circuit for providing a second reference signal, which can be a reference voltage or a reference current. The bias circuit includes a first input resistor in communication with the input terminal and the reference circuit, and a second input resistor in communication with the input terminal and the second input of the first amplifier circuit.

In certain embodiments, the first feedback circuit includes a first feedback resistor and a first feedback capacitor in a parallel configuration. In some embodiments, the integrator circuit includes an inverting amplifier coupled to the output of the first amplifier circuit and a second amplifier circuit. The second amplifier circuit includes a first input, a second input, and an output. The second input is coupled to a third reference signal. The first feedback circuit also includes a second feedback resistor coupled to an output of the unity gain inverting amplifier and the first input of the second amplifier circuit, and a second feedback capacitor coupled to the first input and the output of the second amplifier circuit. In an embodiment, the output of the second amplifier circuit is coupled to the second input of the first amplifier circuit through a third feedback resistor.

In some embodiment, the integrator circuit includes a switched capacitor circuit and a second amplifier circuit. The switched capacitor circuit includes a switch capacitor and a first, a second, a third, and a fourth switches. The first and second switches are coupled to a first terminal of the switch capacitor, whereas the third and fourth switches are couple to a second terminal of the switch capacitor. Additionally, the second and fourth switches are coupled to the first reference signal. The second amplifier circuit includes a first input, a second input, and an output. The first input is in communication with the third switch of the switched capacitor circuit. The second input is coupled to the first reference signal. The second amplifier circuit also includes a second feedback capacitor in communication with the first input and the output of the second amplifier circuit.

In an embodiment, the integrated circuit also includes a supply voltage. The first reference signal is about half of the supply voltage in magnitude for providing maximum signal swing allowed by the supply voltage at the output terminal. In certain embodiment, the integrated circuit is characterized by a DC loop gain, which is sufficiently large to cause a voltage at the output of the first amplifier to be substantially equal to the first reference voltage. In a specific example, the integrated microphone interface circuit is characterized by a DC loop gain ranging from about 80 dB to about 140 dB. In some embodiments, the integrated circuit is characterized by a large DC loop gain and low AC loop gain, causing a DC output voltage at the output terminal to be substantially equal to the first reference voltage, and an AC output voltage to be linearly proportional to the first feedback circuit's impedance and an AC input current or voltage through the input terminal. In another embodiment, the bias circuit provides a programmable voltage or current reference, and the first and the second feedback resistors are programmable.

In a specific embodiment, the present invention provides an integrated circuit for providing a programmable microphone interface. The integrated circuit includes an input terminal for receiving an input signal and an output terminal for providing an output audio signal. The integrated circuit includes a bias circuit in communication with the input terminal. The integrated circuit also includes a first amplifier circuit and multiple feedback circuits. For example, in an embodiment the integrated circuit includes two feedback circuits. The first amplifier circuit includes a first input, a second input, and an output. In the first amplifier, the first input is in communication with the first feedback circuit and, in addition, can be programmed to receive the input signal or a feedback signal. For example, the first input receives the input signal in response to a first mode control signal and receives a feedback signal in response to a second mode control signal. The second input receives the feedback signal in response to the first mode control signal and receives the input signal in response to the second mode control signal. The output provides the output signal to the output terminal. The first feedback circuit is in communication with the output and the first input of the first amplifier, and the first feedback circuit includes a first resistor and a first capacitor connected in parallel. The second feedback circuit includes an integrator circuit in communication with the output of the first amplifier circuit. The second feedback circuit provides the feedback signal.

In a specific embodiment of the integrated circuit, two switching devices are provided. The first switching device couples the first input of the first amplifier circuit to the input signal in response to the first mode control signal and couples the first input to the feedback signal in response to the second mode control signal. The second switching device couples the second input of the first amplifier circuit to the feedback signal in response to the first mode control signal and couples the second input to the input signal in response to the second mode control signal. In a specific embodiment, the integrated circuit is provided in a single integrated circuit chip. In an embodiment, the input terminal is configured to receive an input signal from an electret microphone without requiring an external capacitor. In an embodiment, the bias circuit includes a reference circuit for providing a first reference voltage or current and a first resistor in communication with the input terminal and the voltage reference circuit. In a specific embodiment, the bias circuit is independent of the first feedback circuit and the second feedback circuit.

In an embodiment of the integrated circuit, the integrator includes a switched capacitor circuit, an amplifier, and a capacitor. The switched capacitor circuit includes a second capacitor and a first, a second, a third, and a fourth switches. The first and second switches are coupled to a first terminal of the second capacitor, and the third and fourth switches are couple to a second terminal of the second capacitor. The first and third switches are responsive to a first clock signal, and the second and fourth switches are responsive to a second clock signal. The amplifier circuit includes a first input, a second input, and an output. The first and second inputs are in communication with the third and fourth switches of the switched capacitor circuit, respectively, and the second input is also in communication with a second reference voltage signal. The third capacitor is in communication with the first input and the output of the amplifier. In an embodiment, the second reference voltage signal is about half the supply voltage for providing maximum signal swing at the output.

In a specific embodiment, the integrated circuit is characterized by an large DC loop gain and low AC loop gain, causing the DC output voltage at the output terminal to be substantially equal to the second reference voltage, and the AC output voltage to be linearly proportional to the first feedback circuit's impedance and the AC input current through the input terminal. In an embodiment, the third capacitor is an MOS sandwich capacitor. In an embodiment, the voltage reference circuit provides a programmable voltage reference.

In another embodiment, the invention provides an integrated microphone interface circuit which includes an input terminal for receiving an input signal and an output terminal for providing an output audio signal. The integrated microphone interface circuit includes a first resistor in communication with the input terminal and a first reference circuit which is coupled to the first resistor. The integrated microphone interface circuit also includes a first amplifier circuit and two feedback circuits. The first amplifier circuit includes a first input for the first input receiving the input signal, a second input, and an output for providing the output signal to the output terminal. The first feedback circuit is in communication with the output and the first input of the first amplifier. The first feedback circuit includes a second resistor and a first capacitor connected in parallel. The second feedback circuit includes an integrator circuit and is in communication with the output and the second input of the first amplifier. In an embodiment, the first reference voltage or current is independent of the first feedback circuit and the second feedback circuit.

In an embodiment of the above integrated circuit, the integrated circuit is provided in a single integrated circuit chip. In a specific embodiment of the integrated microphone interface circuit, the input terminal is configured to receive an input signal from an electret microphone without requiring an external capacitor. In an embodiment, the microphone reference is programmable. Embodiments of the invention include various implementations of the integrator. In one example, the integrator includes a second amplifier which includes a first input, a second input and an output. The first input is coupled to a third resistor. The second input is coupled to a second reference voltage signal. A second capacitor is coupled to the first input and the output of the amplifier. In another example, the integrator includes a switched capacitor circuit, an amplifier, and a capacitor. The switched capacitor circuit includes a second capacitor and a first, a second, a third, and a fourth switches. The first and second switches are coupled to a first terminal of the second capacitor, and the third and fourth switches are couple to a second terminal of the second capacitor. The first and third switches are responsive to a first clock signal, and the second and fourth switches are responsive to a second clock signal. The amplifier circuit includes a first input, a second input, and an output. The first and second inputs are in communication with the third and fourth switches of the switched capacitor circuit, respectively, and the second input is also in communication with a second reference voltage signal. The third capacitor is in communication with the first input and the output of the amplifier.

In a specific embodiment, the integrated circuit is characterized by an large DC loop gain and low AC loop gain, causing the DC output voltage at the output terminal to be substantially equal to the second reference voltage, and the AC output voltage to be linearly proportional to the first feedback circuit's impedance and the AC input current through the input terminal. In an embodiment, the third capacitor is an MOS sandwich capacitor. In an embodiment, the voltage reference circuit provides a programmable voltage reference.

In an alternative embodiment, the invention provides an integrated microphone interface circuit which includes an input terminal for receiving an input signal and an output terminal for providing an output audio signal. The interface circuit includes a first resistor in communication with the input terminal and a first reference circuit which is coupled to the first resistor. The microphone interface circuit also includes a first amplifier circuit, the first amplifier circuit including a first input, a second input, and an output. In the first amplifier, the second input receives the input signal, and the output provides the output signal to the output terminal. The microphone interface circuit also includes two feedback circuits. The first feedback circuit is in communication with the output and the first input of the first amplifier, and it includes a second resistor and a first capacitor connected in parallel. The second feedback circuit, the second feedback circuit is in communication with the output and the first input of the first amplifier, and it includes an integrator circuit. In an embodiment, the integrated circuit is provided in a single integrated circuit chip. In a specific embodiment, the input terminal is configured to receive an input signal from an electret microphone without requiring an external capacitor. In another embodiment, the microphone reference voltage or current is programmable, and the first and second resistors are programmable. In a specific embodiment, the microphone reference voltage or current is independent of the first feedback circuit and the second feedback circuit.

Many benefits are achieved by way of the present invention over conventional techniques. For example, in specific embodiments, techniques are provided for integrating both the DC bias and the AC coupling in a single integrated circuit chip without the need for external components and saving pins on the integrated circuit package by combining the AC and DC signal. In an embodiment, techniques are provided for reduced DC bias noise and improved power supply rejection to prevent the interface circuit from interfering with the microphone signal. In an embodiment, techniques are provided to keep microphone voltage reference from being forced onto the amplifier output and limiting the signal swing for large bias voltage requirements, such that the signal at the output would not saturate at the input of the following circuit stage of the integrated circuit. In some embodiments, the methods provided by the invention can save bill of materials (B.O.M.) cost and PCB area in the application. In specific embodiments, techniques are provided to reduce the influence of external noise sources and power supply noise. In some embodiments, a method for a differential interface circuit is also provided. In certain embodiments, the AC and DC characteristics of the interface circuits are determined by on-chip capacitors and resistors, and circuit layout techniques can be used such that accurate matching can be achieved, which would result in accurate gain and time constant parameters. Such parameters are crucial in applications such as beam forming. In addition, a tuning or calibration method can be adopted according to embodiments of the invention, if required. In an embodiment, techniques are provided for a programmable audio squelch by varying the clock frequency of the switched capacitor in the feed back stage. Depending upon the embodiment, one or more of these benefits may be achieved. These and other benefits will be described in more detail throughout the present specification and more particularly below.

Various additional objects, features and advantages of the present invention can be more fully appreciated with reference to the detailed description and accompanying drawings that follow.

DETAILED DESCRIPTION OF THE INVENTION

The present invention is directed to integrated circuits. More particularly, the invention provides a method and device for an integrated circuit for a microphone interface. Merely by way of example, the invention has been applied to interface circuit for an electret microphone. But it would be recognized that the invention has a much broader range of applicability. For example, the invention can be applied to interface circuits to other kinds of microphones or interface circuits to other signal sources.

According to embodiments of the present invention, conventional techniques for interfacing an electret microphone with a CODEC integrated circuit suffer from many limitations. For example, conventional techniques require many off-chip components. Typically, the bias resistance of the microphone is often small, for example, around 1 kΩ, and the bias filter capacitor often is large, e.g., 68 μF. A purpose of this capacitor is to remove the noise from the bias voltage. The bias voltage is often derived from the supply voltage, which often contains switching noises. The larger the filter capacitor, the more noise is removed. The capacitor tends to be very bulky and can occupy a substantial area on the printed circuit board. Moreover, when a microphone is attached to the microphone interface circuit, the DC bias voltage needs to be removed before the microphone AC signal is processed by the amplifier, and AC signals often need to be amplified by a gain stage. Therefore, the gain stage often needs many discreet components such as resistors and capacitors. This also means that any noise or unwanted signals on the microphone bias will be gained up by the gain stage. Therefore, it is desirable to have an improved technique for microphone interface circuits.

Depending upon the embodiment, the present invention includes various features, which may be used. These features include the following:

1. Integration of both the DC bias and the AC coupling on-chip without the need for external components;
2. Programmable control to select two operation modes;
3. Provision for a common mode reference voltage that allows signal calibration and for providing maximum signal swing at the output;
4. Low pin count;
5. Circuit design for reducing influence of external noise sources and power supply noise;
6. An alternative differential interface circuit design;
7. Better gain and time constant control provided by matching on-chip components; and
8. Programmable squelch.

As shown, the above features may be in one or more of the embodiments to follow. These features are merely examples, which should not unduly limit the scope of the claims herein. One of ordinary skill in the art would recognize many variations, modifications, and alternatives.

Figure 1:
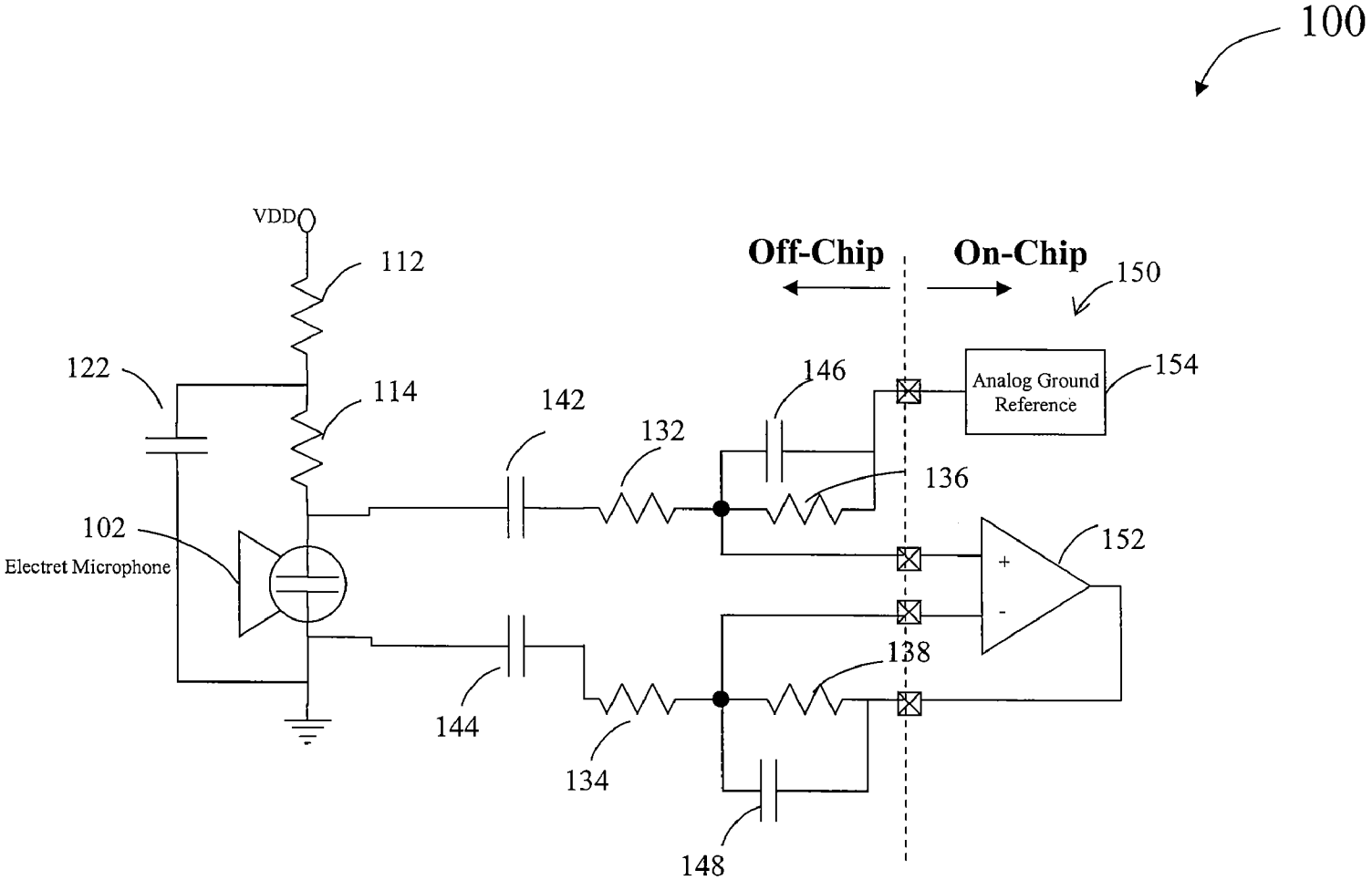
FIG. 1 is a schematic diagram of a conventional microphone-CODEC interface circuit.
Figure 2A:
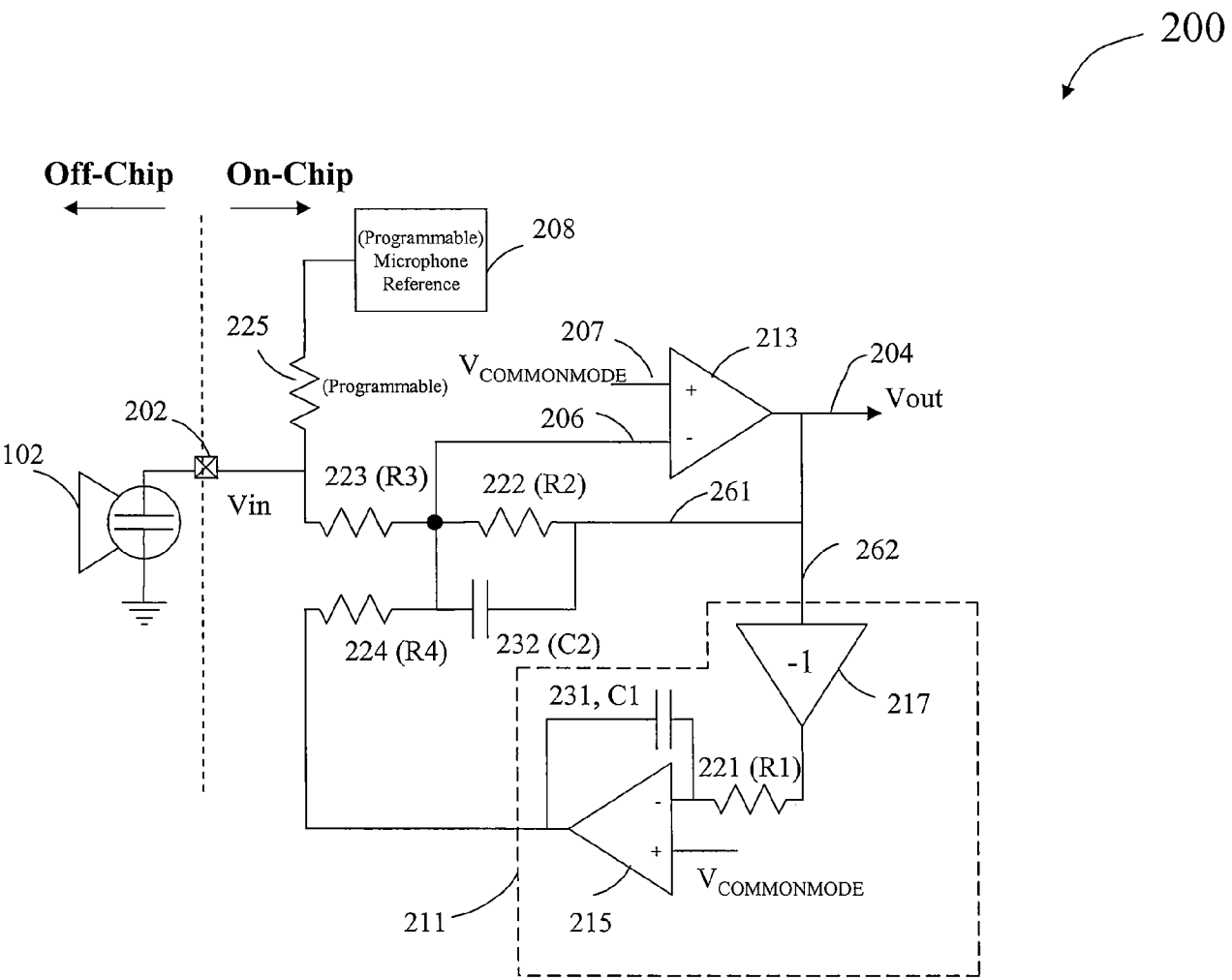
FIG. 2*a* is a simplified schematic diagram of an integrated microphone interface circuit according to an embodiment of the present invention.

FIG. 2*a* is a simplified schematic diagram of an integrated microphone interface circuit 200 according to an embodiment of the present invention. This diagram is merely an example, which should not unduly limit the scope of the claims herein. One of ordinary skill in the art would recognize other variations, modifications, and alternatives. As shown, integrated microphone interface circuit (MIC) 200 includes an input node 202 for receiving an input signal Vin and an output node 204 for delivering an output signal Vout. MIC 200 includes a microphone reference voltage source 208 coupled to Vin through resistor 225. MIC 200 also includes a first amplifier 213 having an input 206 coupled to Vin through a resistor 223 and an output coupled to Vout at 204. Amplifier 213 includes a second input 207 that is coupled to a common-mode reference voltage $V_{commonmode}$. According to embodiments of the invention, MIC 200 includes feedback paths that communicate between the inputs and the output of amplifier 213. In the specific example shown in FIG. 2*a*, MIC 200 includes two feedback paths 261 and 262 that communicate with output 204 and input 206 of amplifier 213. Feedback path 261 includes a parallel combination of a resistor 222 (R2) and a capacitor 232 (C2). Feedback path 262 includes amplifier 217, integrator circuit 211, and resistor 224 (R4) connected in series between the output 204 and input 206 of amplifier 213. In a specific embodiment, integrator circuit 211 includes amplifier 215, resistor 221 (R1) connected to a first input of the amplifier 215, and capacitor 231 (C1) connected between the first input and an output of the amplifier 215. In a specific embodiment, reference voltage $V_{commonmode}$ is connected to a second input of amplifier 215.

In preferred embodiments, the amplifiers 213, 215, and 217 in MIC 200 can be operational amplifiers. But other suitable amplifiers can also be used. In a specific embodiment of the invention, Vin may be an output signal from a microphone 102, e.g., an electret microphone. As an example, Vin may be a voice band or an audio band signal. In an embodiment, Vout may be coupled to an analog-to-digital converter (ADC) of a CODEC (not shown). In certain embodiments, microphone reference voltage source 208 may be a programmable voltage source. In a specific embodiment, an on-chip (programmable) voltage reference 208 provides a DC current to the external microphone through a programmable on-chip resistor 225. In an embodiment, resistors 223 and 225 form a microphone bias circuit, which is in communication with the input terminal 202 and the microphone reference voltage source 208. The bias circuit provides a sensed input signal to input 206 of amplifier 213. As shown in FIG. 2, resistor 225 is in communication with the input terminal 202 and the microphone reference voltage source 208. Similarly, resistor 223 is in communication with the input terminal 202 and resistor 225. In this example, resistor 223 provides the sensed input signal to input 206 of amplifier 213. In a specific embodiment, amplifier 217 has a gain of −1. Of course, there can be other variations, modifications, and alternatives.

According to a specific embodiment of the present invention, a gain transfer function of MIC 200 can be expressed in the following equation.

$$H(s) = \frac{V_{out}(s)}{V_{in}(s)} = \frac{-R_4}{R_3} \cdot \frac{s \cdot R_1 \cdot C_1}{\left(s^2 \cdot R_1 \cdot R_4 \cdot C_1 \cdot C_2 + s \cdot \frac{R_1 \cdot R_4}{R_2} \cdot C_1 + 1\right)}$$

Figure 2B:
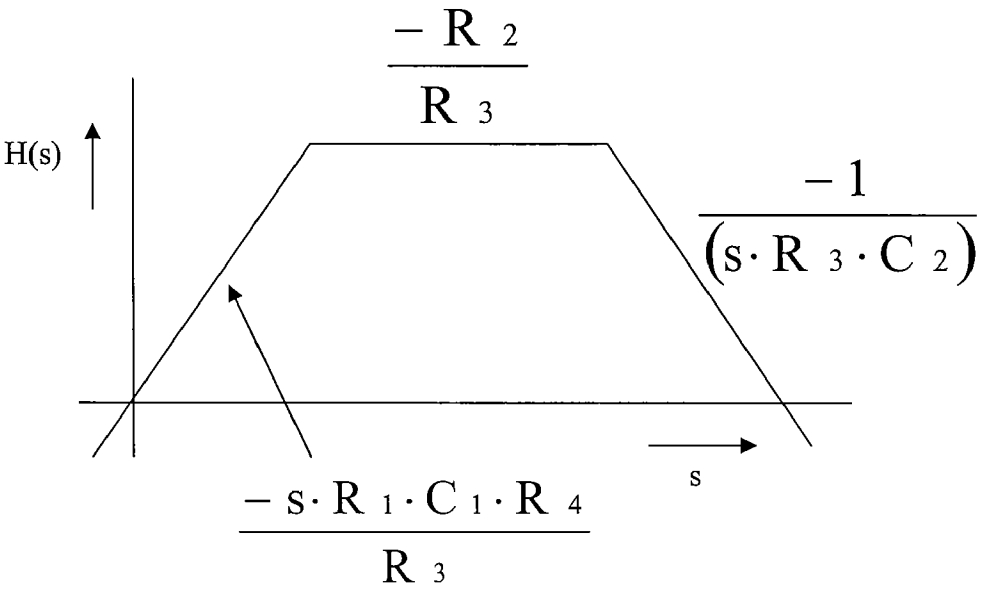
FIG. 2*b* is a simplified graph of a gain transfer function for an integrated microphone interface circuit according to an embodiment of the present invention.

FIG. 2*b* is a simplified graph of a gain transfer function for a microphone interface circuit according to an embodiment of the present invention. This diagram is merely an example, which should not unduly limit the scope of the claims herein. One of ordinary skill in the art would recognize other variations, modifications, and alternatives. As shown, at high frequencies, the gain function can be approximated by the following expression.

$$\frac{-1}{(s \cdot R_3 \cdot C_2)}$$

This AC loop gain of the feedback loop in the voice or audio band frequency range is small, allowing the AC signals to pass through. At lower frequencies, the gain function can be approximated by the following expression.

$$\frac{-R_2}{R_3}$$

According to embodiments of the invention, MIC 200 is characterized by a DC loop gain large enough to force the common mode output voltage of the gain stage to $V_{commonmode}$. For example, in a specific embodiment, MIC 200 can have a DC loop gain of approximately 80 dB to 140 dB.

In embodiments of the invention, microphone interface circuit (MIC) 200 provides both the DC bias and the AC coupling in a single integrated circuit chip without the need for external components. In an embodiment, the circuit that provides the DC bias is independent of the feedback circuits. In a specific embodiment, the desired transfer characteristics can be obtained by, for example, selecting appropriate resistances and capacitances. Merely as examples, resistor 221 (R1) usually has a high resistance ranging from 100 MΩ to 500 MΩ, whereas resistors 222 (R2), 223 (R3), and 224 (R4) may have resistances in the range from 1 kΩ to 500 kΩ. Capacitors 231 (C1) and 232 (C2) may have capacitances in the range from 3 pF to 600 pF. Of course, one of ordinary skill in the art can recognize other variation, modifications, and alternatives.

In certain embodiments of the present invention, $V_{commonmode}$ is an internally generated reference voltage. In a specific preferred embodiment, $V_{commonmode}$ is approximately at half the supply voltage in magnitude for maximum signal swing at the output, which allows further processing without clipping of the voice or audio band signals. Of course, there can be other modifications, variations, and alternatives.

Although the above has been shown using a selected group of components for the microphone interface circuit, there can be many alternatives, modifications, and variations. For example, some of the components may be expanded and/or combined. Other components may be inserted to those noted above. Depending upon the embodiment, the arrangement of components may be interchanged with others replaced. Further details of alternative techniques according to the present invention are found throughout the present specification and more particularly below.

Figure 3:
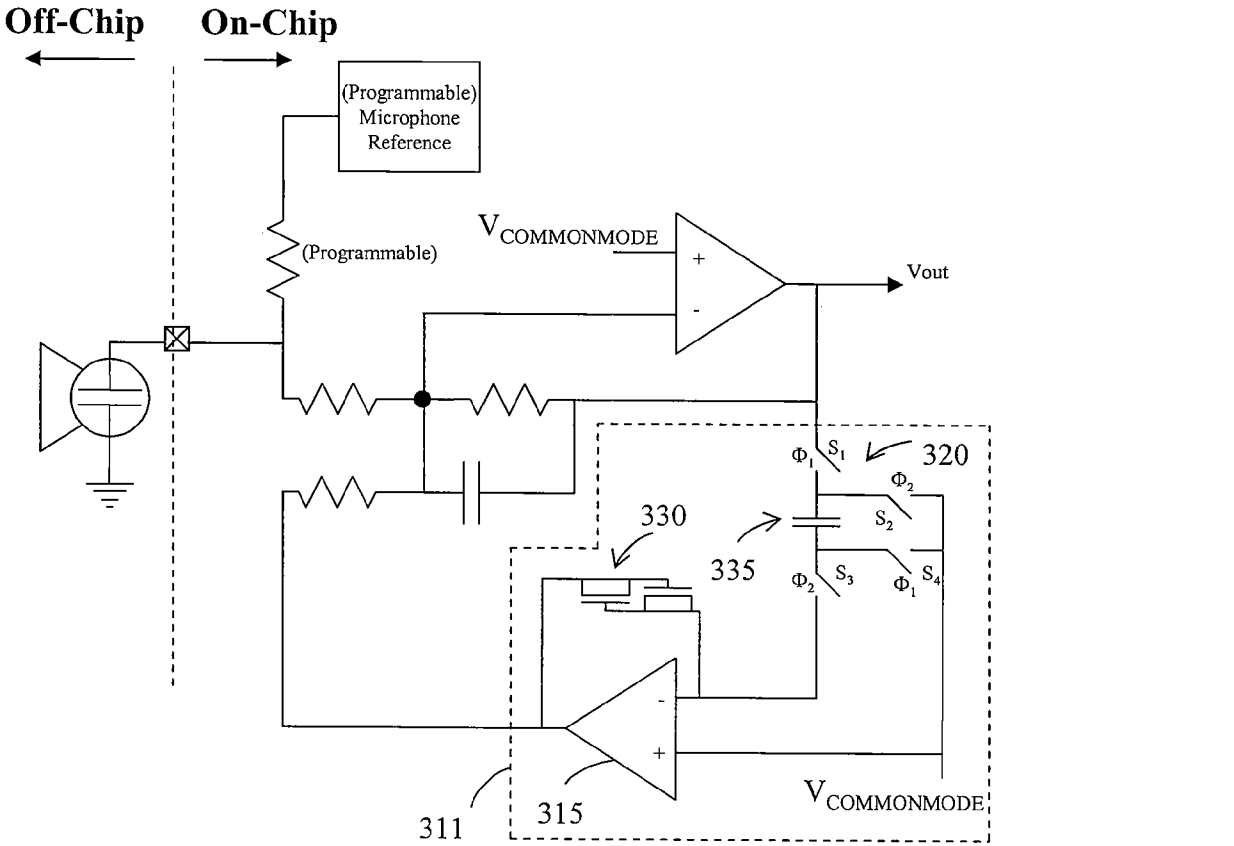
FIG. 3 is a simplified schematic diagram of an integrated microphone interface circuit according to another embodiment of the present invention.

FIG. 3 is a simplified schematic diagram of an integrated microphone interface circuit according to another embodiment of the present invention. This diagram is merely an example, which should not unduly limit the scope of the claims herein. One of ordinary skill in the art would recognize other variations, modifications, and alternatives. As shown, microphone interface circuit 300 is similar to the microphone interface circuit 200 discussed above with reference to FIG. 2. In MIC 300, integrator circuit 311 is used to replace integrator circuit 211 in MIC 200. As shown, integrator circuit 311 includes an amplifier 315, a switched capacitor circuit 320, and a MOS sandwich capacitor 330. This design leads to substantial reduction in device area. The switched capacitor circuit 320 includes a capacitor 335 and four switches, $S_1$, $S_2$, $S_3$, and $S_4$. As shown, $S_1$ and $S_2$ are coupled to a first terminal of the capacitor 335. $S_3$ and $S_4$ are coupled to a second terminal of capacitor 335. In a specific embodiment, $S_2$ and $S_4$ are also coupled to common-mode reference voltage $V_{commonmode}$. In an embodiment, $S_1$ and $S_3$ are responsive to a first clock signal $\Phi_1$, whereas $S_2$ and $S_4$ are responsive to a second clock signal $\Phi_2$. The amplifier circuit 315 includes a first input, a second input, and an output. The first input is in communication with $S_3$, and the second input is in communication with $S_2$ and $S_4$ of the switched capacitor circuit 320. In integrator circuit 311, capacitor 330 is in communication with the first input and the output of the amplifier.

Note that in the integrator stage in MIC 200, the resistor 221 is often a large resistor, for example, 100 MΩ to 500 MΩ, which requires a large device area. In MIC 300, this resistance is provided by a switched capacitor network 320, which can be implemented in a relatively small device area in an integrated circuit. Moreover, since this is a sampled system, the feed back capacitors on the gain stage will provide anti-aliasing filtering and the large integrator capacitors provide the smoothing. In an embodiment, the switched capacitor network is controlled by an on-chip clock signals $\Phi_1$ and $\Phi_2$. By varying the clock frequency a squelch function can be implemented as well.

Also shown in FIG. 3, an MOS sandwich capacitor 330 is used in MIC 300, replacing the feedback capacitor 231 in MIC 200. Feedback capacitor 231 is often large, for example, 100 pF-300 pF. According to an embodiment of the invention, the MOS sandwich capacitor used in MIC 300 provides an advantage of small device area. The non-linearity is less of an issue for this capacitor, since the in band signals will be highly attenuated through this capacitor.

Although the above has been shown using a selected group of components for the microphone interface circuit, there can be many alternatives, modifications, and variations. For example, some of the components may be expanded and/or combined. Other components may be inserted to those noted above. Depending upon the embodiment, the arrangement of components may be interchanged with others replaced. Further details of these components are found throughout the present specification and more particularly below.

Figure 4:
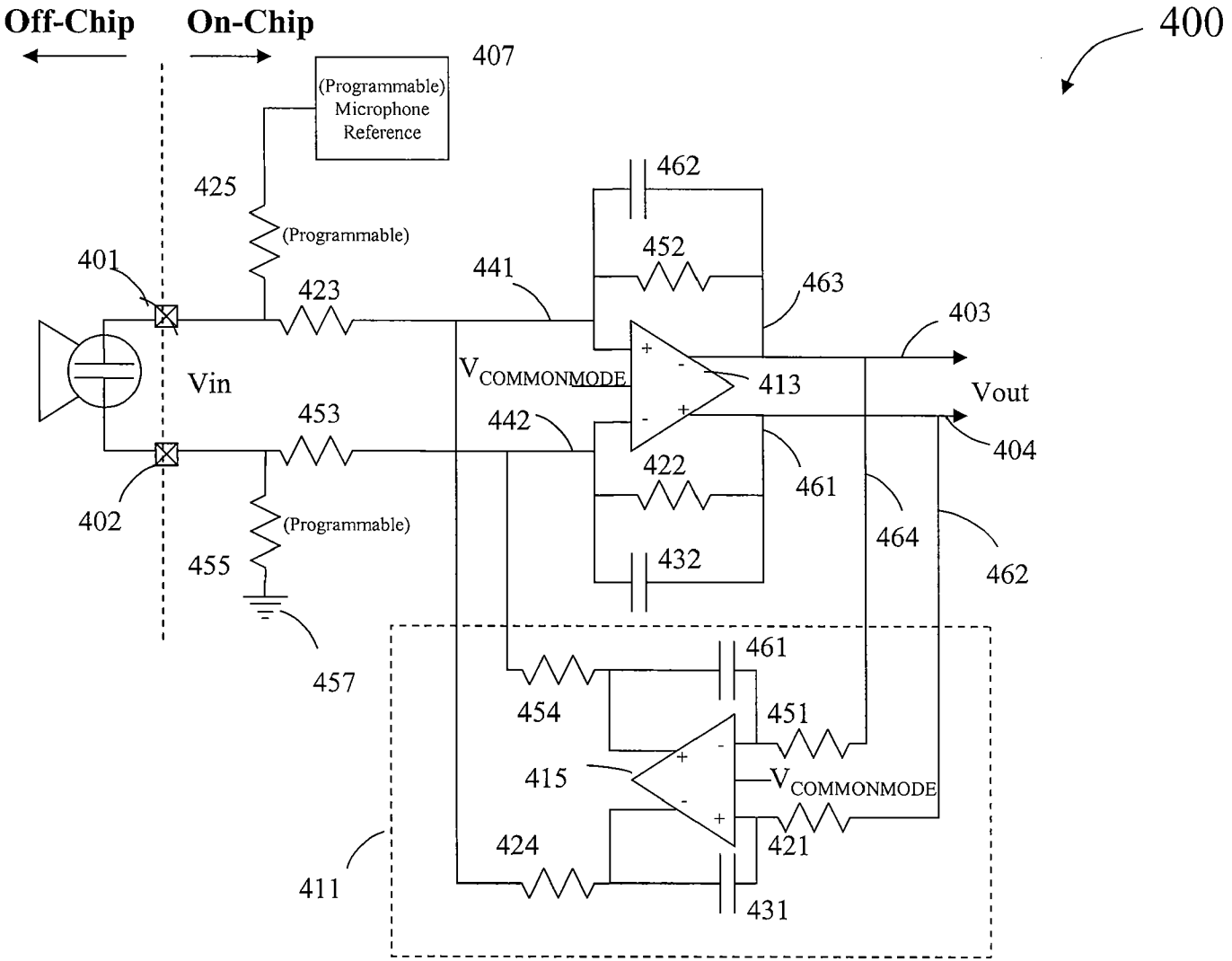
FIG. 4 is a simplified schematic diagram of an integrated differential microphone interface circuit according to an alternative embodiment of the present invention.

FIG. 4 is a simplified schematic diagram of an integrated differential microphone interface circuit according to an alternative embodiment of the present invention. This diagram is merely an example, which should not unduly limit the scope of the claims herein. One of ordinary skill in the art would recognize other variations, modifications, and alternatives. As shown, integrated microphone interface circuit (MIC) 400 includes differential input nodes 401 and 402 for receiving differential input signal Vin. MIC 400 includes differential output nodes 403 and 404 for providing differential output signal Vout. In an embodiment, MIC 400 includes a first microphone bias circuit which includes resistors 423 and 425. A microphone reference voltage source 407 is coupled to input node 401 through resistor 425. MIC 400 also includes and a second microphone bias circuit which includes resistors 453 and 455. Resistor 455 couples input node 402 to a ground voltage 457. In an alternative embodiment, 457 can another reference voltage. MIC 400 also includes a first amplifier 413 having inputs 441 and 442 coupled to 401 and 402 through resistors 423 and 453, respectively. That is, inputs 441 and 442 of amplifier 413 receive sensed input signals provided by the first and second microphone bias circuits, respectively. Amplifier 413 includes an input that is coupled to a common-mode reference voltage $V_{commonmode}$. According to embodiments of the invention, MIC 400 includes feedback paths that communicate between an input and output of amplifier 413. In the specific example shown in FIG. 4, MIC 400 includes four feedback paths 462, 462, 463, and 464 that each communicates with an input and an output of amplifier 413. For example, feedback path 461 between output 404 and input 442 includes a parallel combination of a resistor 422 and a capacitor 432. Feedback path 462 between output 404 and input 441 of amplifier 413 includes resistor 424 connected in series with an integrator that includes amplifier 415, resistor 421, and capacitor 431. Feedback path 463 between output 403 and input 441 includes a parallel combination of resistor 452 and capacitor 462. Feedback path 464 between output 403 and input 442 of amplifier 413 includes resistor 454 connected in series with a second integrator that includes amplifier 415, resistor 451, and capacitor 461. In a specific embodiment, a common mode reference voltage $V_{commonmode}$ is connected to an input of amplifier 415. An alternative description for MIC 400 can be made in terms of differential signals. For example, feedback paths 461 and 463 provide a differential feedback signal from outputs to inputs of amplifier 413, and feedback paths 462 and 464 provide another differential feedback signal from outputs to inputs of amplifier 413. As shown in FIG. 4, feedback paths 462 and 464 form a differential feedback circuit 411.

In preferred embodiments, the amplifiers 413 and 415 in MIC 400 can be operational amplifiers. But other suitable amplifiers can also be used. In a specific embodiment of the invention, Vin may be an output signal from a microphone, for example, an electret microphone. For example, Vin may be voice or audio band signals from a microphone. In an embodiment, Vout may be coupled to an analog-to-digital converter (ADC), for example, of a CODEC. In certain embodiments, microphone reference voltage source 207 may be a programmable voltage source. In a specific embodiment, an on-chip (programmable) voltage reference 407 provides a DC current to the external Microphone through a (programmable) on-chip resistor 425.

According to an embodiment of the invention, MIC 400 provides differential feedback paths. Similar to MIC 200, the AC loop gain of the feedback loop in MIC 400 in the voice or audio band frequency range is small, allowing the AC signals to pass through from the input terminal to the output. According to embodiments of the invention, MIC 400 is characterized by a DC loop gain large enough to force the common mode output voltage of the gain stage to $V_{commonmode}$. For example, in a specific embodiment, MIC 400 can have a DC loop gain of approximately 80 dB to 140 dB. Thus according to embodiments of the invention, microphone interface circuit 400 provides both the DC bias and the AC coupling on-a single integrated circuit chip without the need for external components. In an embodiment, the circuit that provides the DC bias is independent of the feedback circuits.

Although the above has been shown using a selected group of components for the differential microphone interface circuit, there can be many alternatives, modifications, and variations. For example, some of the components may be expanded and/or combined. Other components may be inserted to those noted above. Depending upon the embodiment, the arrangement of components may be interchanged with others replaced. Further details of these components are found throughout the present specification and more particularly below.

Figure 5:
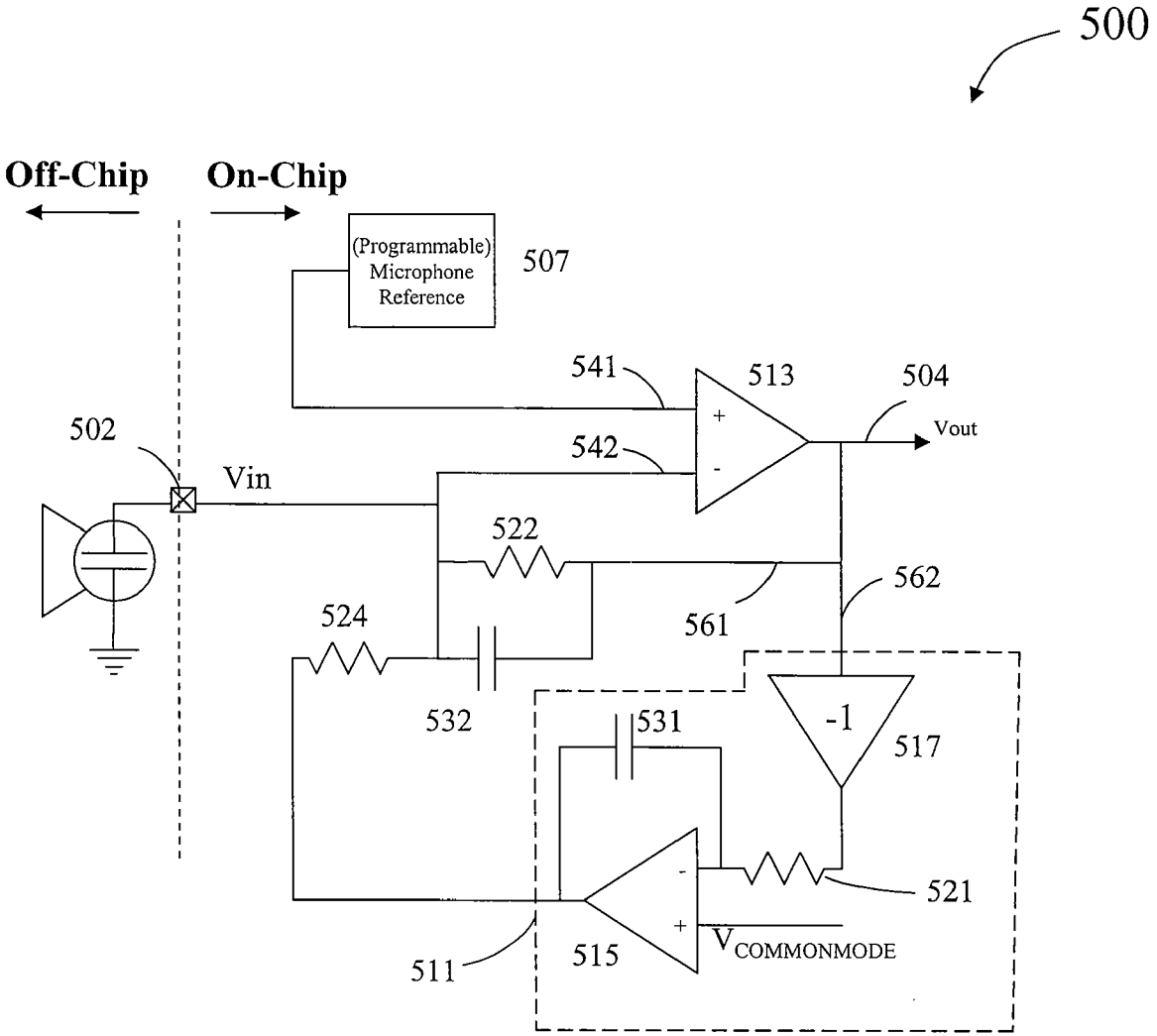
FIG. 5 is a simplified schematic diagram of an integrated microphone interface circuit according to yet another embodiment of the present invention.

FIG. 5 is a simplified schematic diagram of a microphone interface circuit according to yet another embodiment of the present invention. This diagram is merely an example, which should not unduly limit the scope of the claims herein. One of ordinary skill in the art would recognize other variations, modifications, and alternatives. As shown, integrated microphone interface circuit (MIC) 500 includes an input node 502 for receiving an input signal Vin and an output node 504 for delivering an output signal Vout. MIC 500 includes a microphone reference voltage source 507. MIC 200 also includes a first amplifier 513 having inputs 541 and 542 and an output coupled to Vout at 504. Input 542 is coupled to Vin, and the second input 541 is coupled to the microphone reference voltage source 507. According to embodiments of the present invention, MIC includes a feedback circuit between an input and output of amplifier 513. In the specific example shown in FIG. 5, MIC 500 includes two feedback paths that communicate with an input and an output of amplifier 513. Feedback path 561 includes a parallel combination of a resistor 522 and a capacitor 532. Feedback path 562 includes integrator circuit 511, and resistor 524 connected in series between the output and input of amplifier 513. In a specific embodiment, integrator circuit 511 includes amplifier 517, amplifier 515, resistor 521, and capacitor 531. Resistor 521 is connected to an input of amplifier 515, and capacitor 531 is connected between an input and an output of amplifier 515. In a specific embodiment, reference voltage $V_{commonmode}$ is connected to an input of amplifier 515.

In preferred embodiments, the amplifiers in MIC 500 can be operational amplifiers. But other suitable amplifiers can also be used. In a specific embodiment of the invention, Vin may be an output signal from a microphone, for example, an electret microphone. For example, Vin may be voice or audio band signals from a microphone. In an embodiment, Vout may be coupled to an analog-to-digital converter (ADC), for example, of a CODEC. In certain embodiments, microphone reference voltage source 507 may be a programmable voltage source. In an embodiment, amplifier 517 has a gain of −1.

According to an embodiment of the invention, MIC 500 includes feedback paths 561 and 562 that perform functions similar to feedback paths in MIC 200 described above with reference to FIG. 2*a*. In MIC 500, the AC loop gain of the feedback loop in the voice or audio band frequency range is small, allowing the AC signals to pass through from the input terminal to the output. According to embodiments of the invention, MIC 500 is characterized by a DC loop gain large enough to force the output voltage to the common mode voltage. For example, in a specific embodiment, MIC 500 can have a DC loop gain of approximately 80 dB to 140 dB. Thus according to embodiments of the invention, microphone interface circuit 500 provides both the DC bias and the AC coupling in a single integrated circuit chip without the need for external components. In an embodiment, the circuit that provides the DC bias is independent of the feedback circuits.

Figure 6:
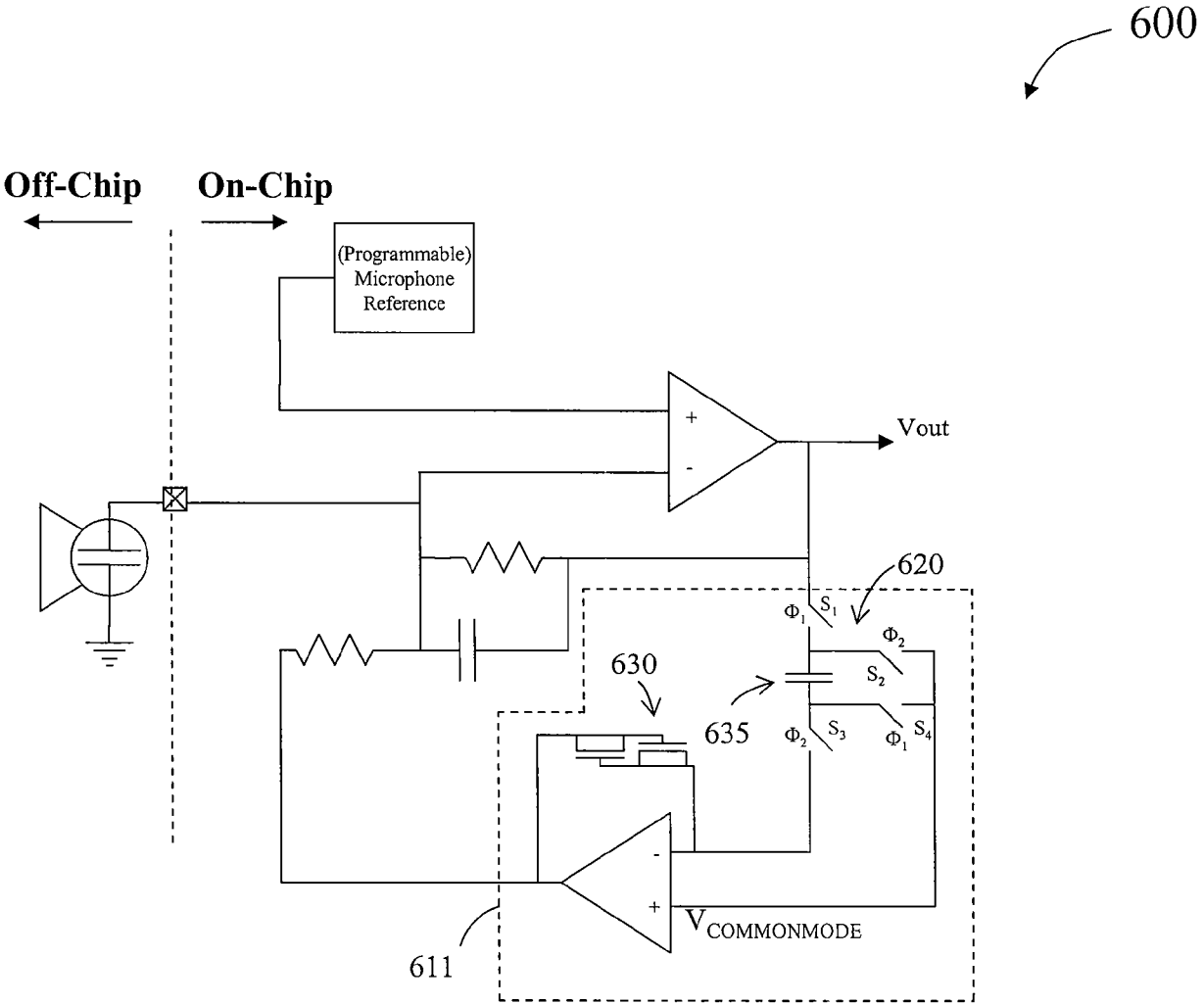
FIG. 6 is a simplified schematic diagram of an integrated microphone interface circuit according to another alternative embodiment of the present invention.

FIG. 6 is a simplified schematic diagram of an integrated microphone interface circuit according to another alternative embodiment of the present invention. This diagram is merely an example, which should not unduly limit the scope of the claims herein. One of ordinary skill in the art would recognize other variations, modifications, and alternatives. As shown, microphone interface circuit 600 is similar to the microphone interface circuit 500 discussed with reference to FIG. 5. Note that MIC 600 includes an integrator circuit 611 in place of integrator circuit 511 in MIC 500. As shown, integrator circuit 611 includes switch capacitor network 620 and MOS sandwich capacitor 630. The general operations of integrator circuit 611 can be understood with reference to the discussion above on MIC 500 and FIG. 5. However, in comparison with MIC 500, MIC 600 offers advantages in reduced device area provided by, for example, the switched capacitor network and the MOS sandwich capacitor.

Figure 7:
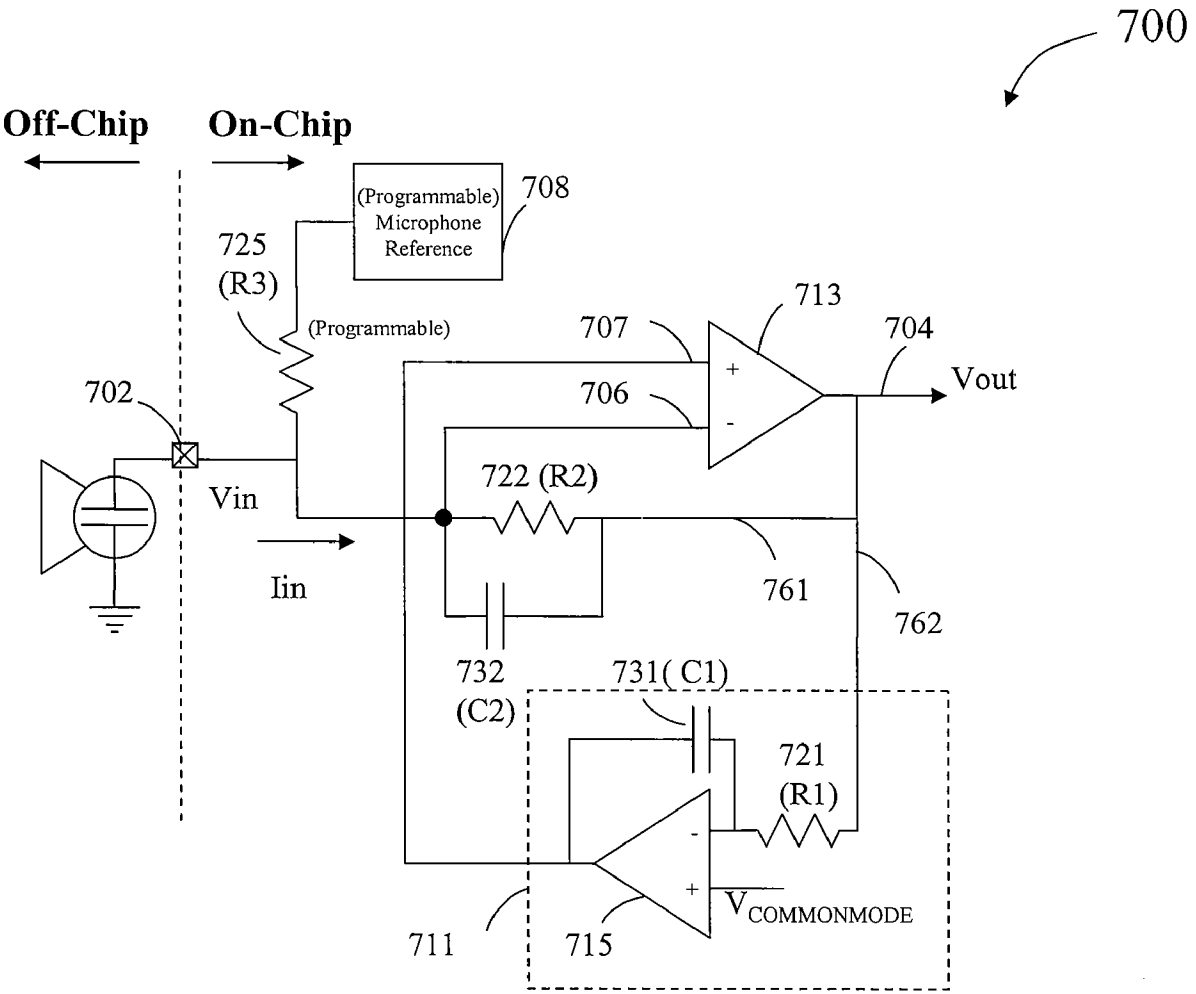
FIG. 7 is a simplified schematic diagram of an integrated microphone interface circuit according to yet another embodiment of the present invention.

FIG. 7 is a simplified schematic diagram of a microphone interface circuit according to yet another embodiment of the present invention. This diagram is merely an example, which should not unduly limit the scope of the claims herein. One of ordinary skill in the art would recognize other variations, modifications, and alternatives. As shown, integrated microphone interface circuit (MIC) 700 includes an input terminal 702 for receiving an input signal Vin and an output node 704 for providing an output signal Vout. MIC 700 includes a microphone reference circuit 708 coupled to Vin through resistor 725 (R3). Depending on the embodiment, microphone reference circuit 708 can provide a reference voltage or a reference current. MIC 700 also includes a first amplifier 713 having an input 706 coupled to Vin to receive a current Vin and an output coupled to the output terminal 704. Amplifier 713 includes a second input 707 that receives a feedback signal from feedback circuit 762 as discussed below. According to embodiments of the invention, MIC 700 includes feedback circuits that communicate with the inputs and output of amplifier 713. In the specific example shown in FIG. 7, MIC 700 includes two feedback paths 761 and 762 that communicate with output 704 and inputs 706 and 707, respectively, of amplifier 713. Feedback path 761 includes a parallel combination of a resistor 722 (R2) and a capacitor 732 (C2). Feedback path 762 includes integrator circuit 711 connected between the output 704 and input 707 of amplifier 713. In a specific embodiment, integrator circuit 711 includes amplifier 715, resistor 721 (R1) connected to an input of the amplifier 715, and capacitor 731 (C1) connected between an input and an output of the amplifier 715. In an embodiment, resistors 722 and 725 are programmable resistors. In a specific embodiment, reference voltage $V_{commonmode}$ is connected to a second input of amplifier 715.

In preferred embodiments, the amplifiers in MIC 700 can be operational amplifiers. But other suitable amplifiers can also be used. In a specific embodiment of the invention, the signal Vin at the input terminal 702 may be an output signal from a microphone, for example, an electret microphone. For example, other types of microphones can also be used. Depending on the application, Vin may be a voice band signal or audio band signal. In an embodiment, the output signal Vout may be an audio band signal coupled to an analog-to-digital converter (ADC) of a CODEC. In certain embodiments, microphone reference circuit 708 may be a programmable voltage source. In a specific embodiment, an on-chip programmable reference 708 provides a DC current to the external microphone through an on-chip resistor 725. In an embodiment, resistor 725 is a programmable resistor. Thus, in an embodiment, the invention provides an on-chip microphone bias circuit which includes resistor 725 and voltage reference source 708. In certain embodiments of the present invention, $V_{commonmode}$ is an internally generated reference voltage. In a specific preferred embodiment, $V_{commonmode}$ is approximately at half the supply voltage for maximum signal swing at the output, which allows further processing without clipping of the voice or audio band signals. Of course, there can be other modifications, variations, and alternatives.

According to an embodiment of the present invention, the gain transfer function of MIC 700 can be expressed by the following expressions.

$$H(s) = \frac{V_{out}(s)}{I_{in}(s)} = \frac{-R_2}{\frac{R_2+R_3}{R_3}} \cdot \frac{s \cdot R_1 \cdot C_1}{\left(s^2 \cdot \frac{R_1 \cdot R_2 \cdot R_3 \cdot C_1 \cdot C_2}{R_2+R_3} + s \cdot \frac{R_3 \cdot (R_1 \cdot C_1 + R_2 \cdot C_2)}{R_2+R_3} + 1\right)}$$

At high frequencies, the gain transfer function of MIC 700 can be approximated by the following expressions.

$$H(s) = \frac{V_{out}(s)}{I_{in}(s)} = -\frac{1}{(s \cdot C_2)}$$

At lower frequencies, the gain function can be approximated by the following expression.

$$H(s) = \frac{V_{out}(s)}{I_{in}(s)} \approx -R_2$$

According to embodiments of the invention, the AC loop gain of the feedback loop in the voice or audio band frequency range is small, and the DC loop gain is large. For example, in a specific embodiment, MIC 700 can have a DC loop gain of approximately 80 dB to 140 dB. More specifically, MIC 700 is characterized by a large DC loop gain and low AC loop gain, causing the DC output voltage at the output terminal to be substantially equal to the second reference voltage; and the AC output voltage to be linearly proportional to the first feedback circuit's impedance and the AC input current or voltage through the input terminal.

In embodiments of the invention, microphone interface circuit (MIC) 700 provides both the DC bias and the AC coupling in a single integrated circuit chip without the need for external components. In an embodiment, the circuit that provides the DC bias is independent of the feedback circuits. In a specific embodiment, the desired transfer characteristic, such as microphone bias, high DC loop gain and low AC loop gain, can be obtained by selecting proper resistances and capacitances. Merely as an example, resistor 721 (R1) usually has a high resistance ranging from 100 MΩ to 500 MΩ, whereas resistors 722 (R2) and 723 (R3) may have resistances in the range from 1 kΩ to 500 kΩ. Capacitors 731 (C1) and 732 (C2) may have capacitances in the range from 3 pF to 500 pF.

Although the above has been shown using a selected group of components for the microphone interface circuit, there can be many alternatives, modifications, and variations. For example, some of the components may be expanded and/or combined. Other components may be inserted to those noted above. Depending upon the embodiment, the arrangement of components may be interchanged with others replaced. Further details of alternative techniques according to the present invention are found throughout the present specification and more particularly below.

Figure 8:
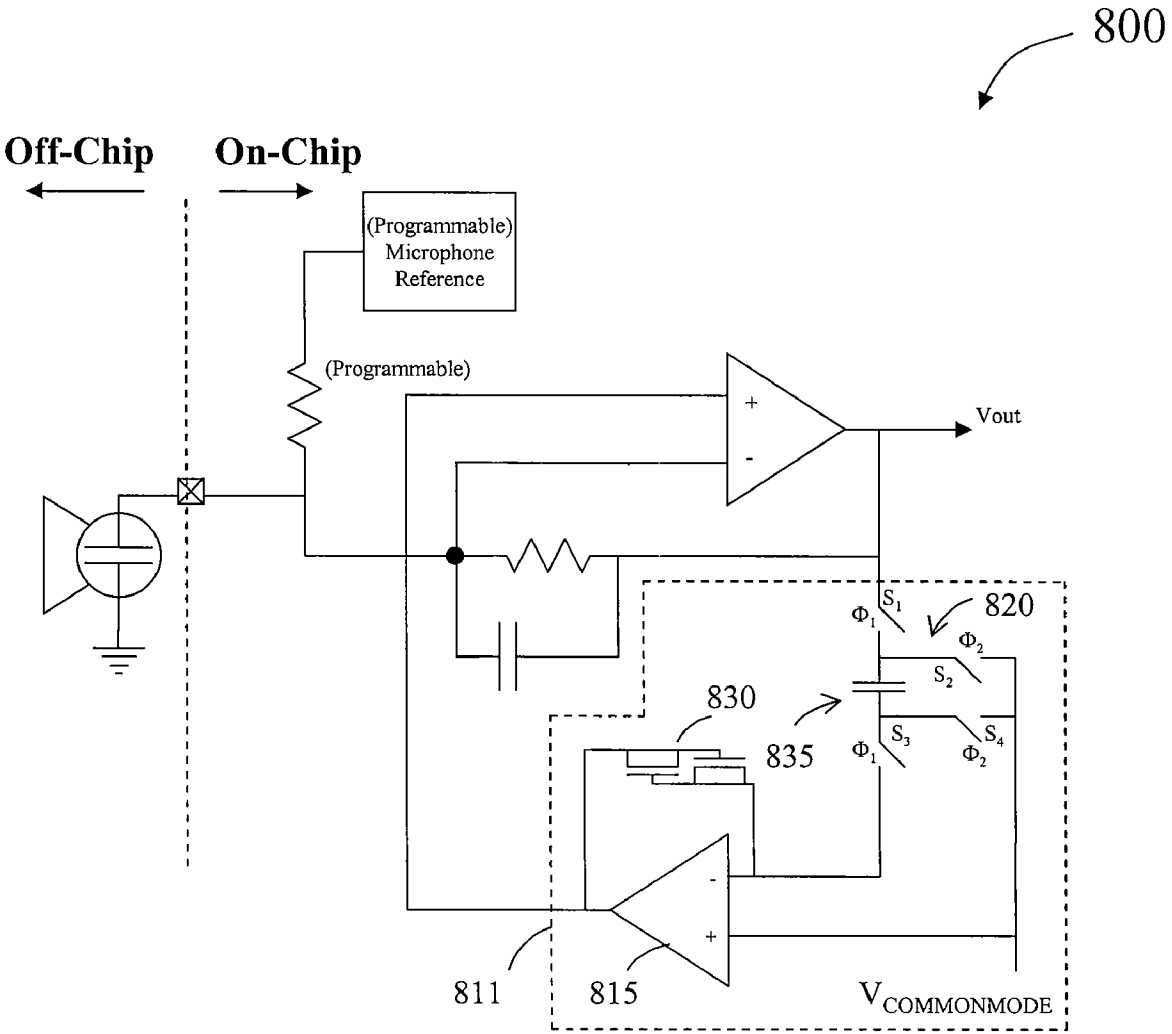
FIG. 8 is a simplified schematic diagram of an integrated microphone interface circuit according to another alternative embodiment of the present invention.

FIG. 8 is a simplified schematic diagram of an integrated microphone interface circuit according to another embodiment of the present invention. This diagram is merely an example, which should not unduly limit the scope of the claims herein. One of ordinary skill in the art would recognize other variations, modifications, and alternatives. As shown, microphone interface circuit (MIC) 800 is generally similar to the microphone interface circuit 700 discussed above with reference to FIG. 7. In FIG. 8, MIC 800 includes integrator circuit 811 to replace integrator circuit 711 in MIC 700. As shown, integrator circuit 811 includes an amplifier 815, a switched capacitor circuit 820, and a MOS sandwich capacitor 830. This design leads to substantial reduction in device areas. The switched capacitor circuit 820 includes a capacitor 835 and four switches, $S_1$, $S_2$, $S_3$, and $S_4$. As shown, $S_1$ and $S_2$ are coupled to a first terminal of the capacitor 835. $S_3$ and $S_4$ are coupled to a second terminal of capacitor 835. In a specific embodiment, $S_2$ and $S_4$ are also coupled to common-mode reference voltage $V_{commonmode}$. In an embodiment, $S_1$ and $S_3$ are responsive to a first programmable clock signal $\Phi_1$, whereas $S_2$ and $S_4$ are responsive to a second programmable clock signal $\Phi_2$. The amplifier circuit 815 includes a first input, a second input, and an output. The first input is in communication with $S_3$, and the second input is in communication with $S_2$ and $S_4$ of the switched capacitor circuit 820. In integrator circuit 811, capacitor 830 is in communication with the first input and the output of the amplifier.

According to an embodiment of the present invention, the gain transfer function of MIC 800 can be expressed by the following expressions.

$$H(s) = \frac{V_{out}(s)}{I_{in}(s)} \approx \frac{-R_2}{\frac{R_2 + R_3}{R_3}} \cdot \frac{s \cdot \left(\frac{T_\Phi}{C_{835}}\right) \cdot C_1}{\left(s^2 \cdot \frac{\left(\frac{T_\Phi}{C_{835}}\right) \cdot R_2 \cdot R_3 \cdot C_1 \cdot C_2}{R_2 + R_3} + s \cdot \frac{R_3 \cdot \left(\left(\frac{T_\Phi}{C_{835}}\right) \cdot C_1 + R_2 \cdot C_2\right)}{R_2 + R_3} + 1\right)}$$

In embodiments of the invention, the operation of microphone interface circuit MIC 800 is generally similar to that of MIC 700. For example, the feedback circuit in MIC 800 provides high DC loop gain and low AC loop gain. MIC 800 provides both the DC bias and the AC coupling on-chip without the need for external components. In additional, MIC 800 offers the advantage of reduced device area compared to MIC 700.

As discussed above, in the integrator stage in MIC 700, the resistor 721 is often a large resistor, for example, 100 MΩ to 500 MΩ, which requires a large device area. In MIC 800, this resistance is provided by a switched capacitor network 820, which can be implemented using a smaller device area than a large resistor. Moreover, since this is a sampled system, the feed back capacitors on the gain stage will provide anti-aliasing filtering and the large integrator capacitors provide the smoothing. In an embodiment, the switched capacitor network is controlled by an on-chip clock signals $\Phi_1$ and $\Phi_2$. By varying the clock frequency a squelch function can be implemented as well.

Also shown in FIG. 8, MOS sandwich capacitor 830 is used in MIC 800, replacing the feedback capacitor 731 in MIC 700 in FIG. 7. Feedback capacitor 731 is often large, for example, 100 pF-300 pF. According to an embodiment of the invention, the MOS sandwich capacitor used in MIC 800 provides the desired capacitance with a smaller device area.

In embodiments of the invention, the operation of microphone interface circuit MIC 800 is generally similar to that of MIC 700. For example, the feedback circuit in MIC 800 provides high DC loop gain and low AC loop gain. MIC 800 provides both the DC bias and the AC coupling in a single integrated circuit chip without the need for external components. In an embodiment, the circuit that provides the DC bias is independent of the feedback circuits. In addition, MIC 800 offers the advantage of reduced device area compared to MIC 700.

Although the above has been shown using a selected group of components for the microphone interface circuit, there can be many alternatives, modifications, and variations. For example, some of the components may be expanded and/or combined. Other components may be inserted to those noted above. Depending upon the embodiment, the arrangement of components may be interchanged with others replaced. Further details of these components are found throughout the present specification and more particularly below.

Figure 9:
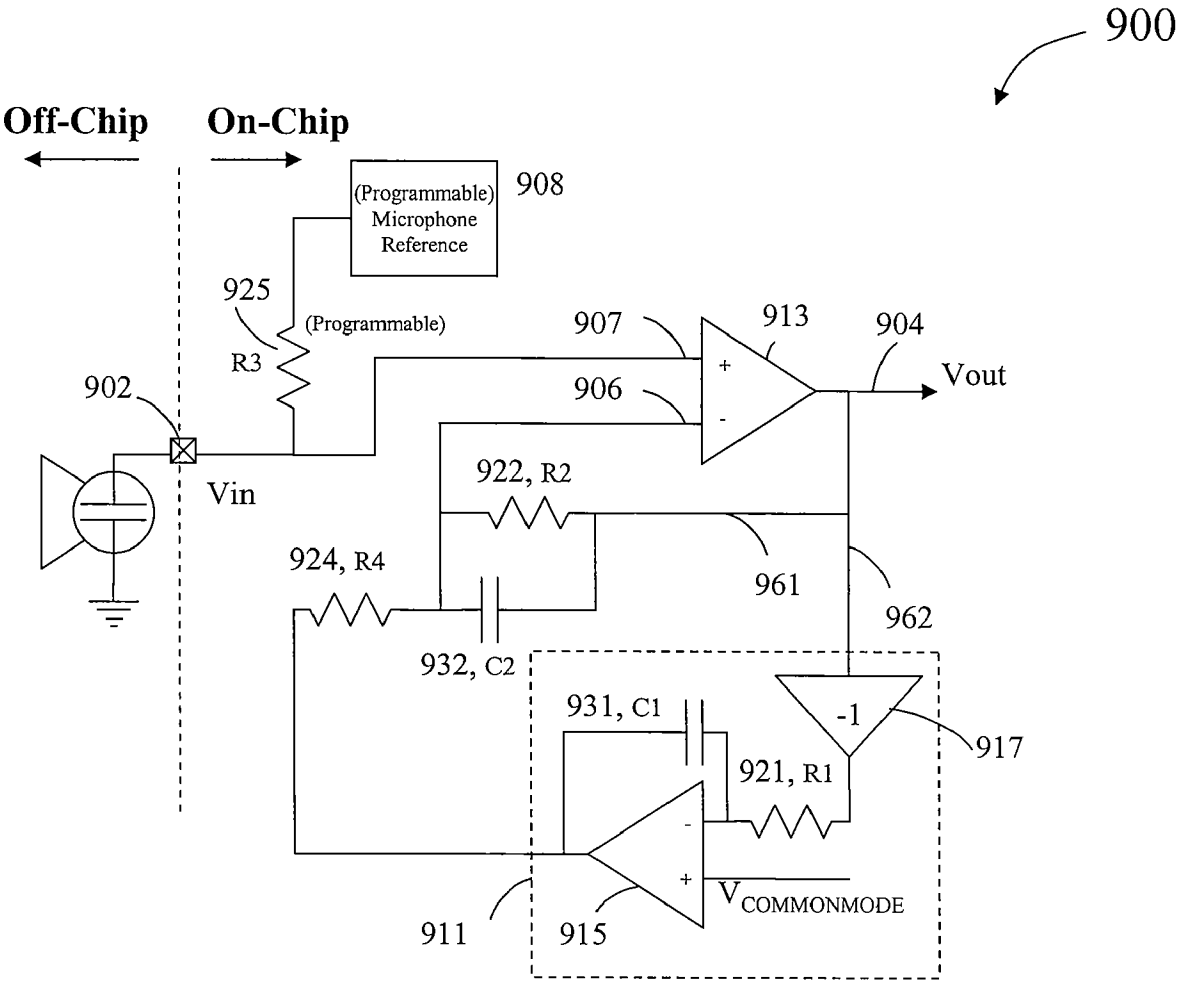
FIG. 9 is a simplified schematic diagram of an integrated microphone interface circuit according to yet another embodiment of the present invention.

FIG. 9 is a simplified schematic diagram of an integrated microphone interface circuit according to yet another embodiment of the present invention. This diagram is merely an example, which should not unduly limit the scope of the claims herein. One of ordinary skill in the art would recognize other variations, modifications, and alternatives. As shown, integrated microphone interface circuit (MIC) 900 includes an input terminal 902 for receiving an input signal Vin and an output node 904 for providing an output signal Vout. MIC 900 also includes a microphone reference 908 coupled to Vin through resistor 925 (R3). Depending on the embodiment, microphone reference 908 can provide a reference voltage or a reference current. MIC 900 also includes a first amplifier 913 having an input 907 coupled to Vin and an output coupled to the output terminal 904. Amplifier 913 includes a second input 906 that receives feedback signals from the feedback circuits as discussed below. According to embodiments of the invention, MIC 900 includes feedback circuits that communicate between an input and output of amplifier 913. In the specific example shown in FIG. 9, MIC 900 includes two feedback paths 961 and 962 that communicate with output 904 and inputs 906 and 907 of amplifier 213. Feedback path 961 includes a parallel combination of a resistor 922 (R2) and a capacitor 932 (C2). Feedback path 962 includes amplifier circuit 917, integrator circuit 911, and resistor 924 connected in series between the output 904 and input 906 of amplifier 913. In a specific embodiment, integrator circuit 911 includes amplifier 915, resistor 921 (R1) connected to an input of the amplifier 915, and capacitor 931 (C1) connected between an input and an output of the amplifier 915. In an embodiment, resistors 922 and 925 are programmable resistors. In a specific embodiment, reference voltage $V_{commonmode}$ is connected to a second input of amplifier 915.

In preferred embodiments, the amplifiers in MIC 900 can be operational amplifiers. But other suitable amplifiers can also be used. In an embodiment, amplifier circuit 917 has a gain of −1. In a specific embodiment of the invention, input terminal 902 may receive Vin as an output signal from a microphone, for example, an electret microphone. Depending on the embodiment, other types of microphones can also be used. Depending on the application, Vin may be a voice band signal or audio band signal. In an embodiment, the output signal Vout may be an audio band signal coupled to an analog-to-digital converter (ADC) of a CODEC. In certain embodiments, microphone reference 908 may be a programmable voltage source. In a specific embodiment, an on-chip programmable microphone reference 908 provides a DC current to the external microphone through an on-chip resistor 925. In an embodiment, resistor 925 is a programmable resistor. Thus, in an embodiment, the invention provides an on-chip microphone bias circuit which includes resistor 925 and voltage reference source 908. In certain embodiments of the present invention, $V_{commonmode}$ is an internally generated reference voltage. In a specific preferred embodiment, $V_{commonmode}$ is approximately at half the supply voltage for maximum signal swing at the output, which allows further processing without clipping of the voice or audio band signals. Of course, there can be other modifications, variations, and alternatives.

According to an embodiment of the present invention, the gain transfer function of MIC 900 can be expressed by the following expressions.

$$H(s) = \frac{V_{out}(s)}{V_{in}(s)} = \frac{R_2 + R_4}{R_2} \cdot \frac{s \cdot R_1 \cdot C_1 \cdot \left(1 + s \cdot R_4 \cdot C_2 \cdot \frac{R_2}{R_2 + R_4}\right)}{\left(s^2 \cdot R_1 2 \cdot 5R_4 \cdot C_1 \cdot C_2 + s \cdot R_1 \cdot C_1 \cdot \frac{R_4}{R_2} + 1\right)}$$

According to an embodiment of the present invention, a gain transfer function of MIC 900 can be approximated, at high frequencies, by the following expression.

$$H(s) = \frac{V_{out}(s)}{V_{in}(s)} = 1$$

At lower frequencies, the gain function can be approximated by the following expression.

$$H(s) = \frac{V_{out}(s)}{V_{in}(s)} = 1 + \frac{R_2}{R_4}$$

According to embodiments of the invention, the AC loop gain of the feedback loop in the voice or audio band frequency range is small, and the DC loop gain is large. For example, in a specific embodiment, MIC 900 can have a DC loop gain of approximately 80 dB to 140 dB. More specifically, MIC 900 is characterized by a large DC loop gain and low AC loop gain, causing the DC output voltage at the output terminal to be substantially equal to the second reference voltage; and the AC output voltage in the audio band to be linearly proportional to $$1 + \frac{R_2}{R_4}$$

and the AC input voltage at the input terminal.

In embodiments of the invention, microphone interface circuit (MIC) 900 provides both the DC bias and the AC coupling in a single integrated circuit chip without the need for external components. In an embodiment, the circuit that provides the DC bias is independent of the feedback circuits. In a specific embodiment, the desired transfer characteristics can be obtained by selecting proper resistances and capacitances. Merely as an example, resistor 921 (R1) usually has a high resistance ranging from 100 MΩ to 500 MΩ, whereas resistors 922 (R2), 923 (R3), and 924 (R4) may have resistances in the range from 1 kΩ to 500 kΩ. Capacitors 931 (C1) and 932 (C2) may have capacitances in the range from 3 pF to 500 pF. Of course, one of ordinary skill in the art can recognize other variation, modifications, and alternatives.

Figure 10:
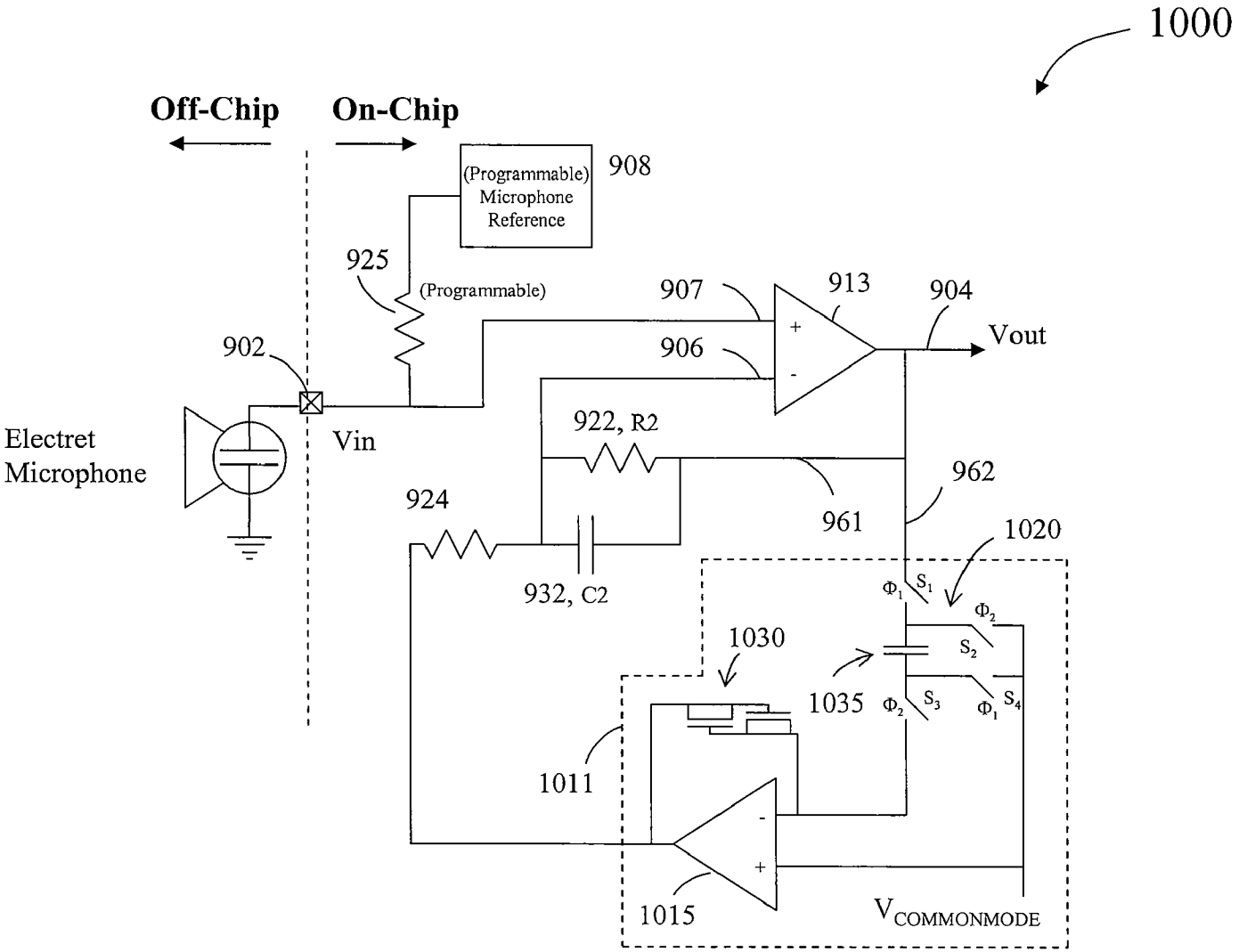
FIG. 10 is a simplified schematic diagram of an integrated microphone interface circuit according to another alternative embodiment of the present invention.

FIG. 10 is a simplified schematic diagram of an integrated microphone interface circuit according to another embodiment of the present invention. This diagram is merely an example, which should not unduly limit the scope of the claims herein. One of ordinary skill in the art would recognize other variations, modifications, and alternatives. As shown, microphone interface circuit (MIC) 1000 is generally similar to the microphone interface circuit 900 discussed above with reference to FIG. 9. In FIG. 10, MIC 1000 includes integrator circuit 1011 to replace integrator circuit 911 in MIC 900. As shown, integrator circuit 1011 includes an amplifier 1015, a switched capacitor circuit 1020, and a MOS sandwich capacitor 1030. This design leads to substantial reduction in device area. The switched capacitor circuit 1020 includes a capacitor 1035 and four switches, $S_1$, $S_2$, $S_3$, and $S_4$. As shown, $S_1$ and $S_2$ are coupled to a first terminal of the capacitor 1035. $S_3$ and $S_4$ are coupled to a second terminal of capacitor 1035. In a specific embodiment, $S_2$ and $S_4$ are also coupled to common-mode reference voltage $V_{commonmode}$. In an embodiment, $S_1$ and $S_4$ are responsive to a first programmable clock signal $\Phi_1$, whereas $S_2$ and $S_3$ are responsive to a second programmable clock signal $\Phi_2$. The amplifier circuit 1015 includes a first input, a second input, and an output. The first input is in communication with $S_3$, and the second input is in communication with $S_2$ and $S_4$ of the switched capacitor circuit 1020. In integrator circuit 1011, capacitor 1030 is in communication with the first input and the output of the amplifier 1015. In certain embodiments of the present invention, $V_{commonmode}$ is an internally generated reference voltage. In a specific preferred embodiment, $V_{commonmode}$ is approximately at half the supply voltage for maximum signal swing at the output.

According to an embodiment of the present invention, the gain transfer function of MIC 1000 can be expressed by the following expressions.

$$H(s) = \frac{V_{out}(s)}{V_{in}(s)} \approx \frac{R_2 + R_4}{R_2} \cdot \frac{s \cdot \left(\frac{T_\Phi}{C_{1035}}\right) \cdot C_1 \cdot \left(1 + s \cdot R_4 \cdot C_2 \cdot \frac{R_2}{R_2 + R_4}\right)}{\left(s^2 \cdot \left(\frac{T_\Phi}{C_{1035}}\right) \cdot R_4 \cdot C_1 \cdot C_2 + s \cdot \left(\frac{T_\Phi}{C_{1035}}\right) \cdot C_1 \cdot \frac{R_4}{R_2} + 1\right)}$$

In embodiments of the invention, the operation of microphone interface circuit MIC 1000 is generally similar to that of MIC 900. For example, the feedback circuit in MIC 1000 provides high DC loop gain and low AC loop gain. MIC 1000 provides both the DC bias and the AC coupling in a single integrated circuit chip without the need for external components. In an embodiment, the circuit that provides the DC bias is independent of the feedback circuits. In additional, MIC 1000 offers an advantage of reduced device area compared to MIC 900.

As discussed above, in the integrator stage in MIC 900, the resistor 921 is often a large resistor, for example, 100 MΩ to 500 MΩ, which requires a large device area. In MIC 1000, this resistance is provided by a switched capacitor network 1020, which can be implemented using a smaller device area than a large resistor. Moreover, since this is a sampled system, the feed back capacitor on the gain stage will provide anti-aliasing filtering and the large integrator capacitor provides the smoothing. The switched capacitor network is controlled by an on-chip clock signals $\Phi_1$ and $\Phi_2$. By varying the clock frequency a squelch function can be implemented as well.

Also shown in FIG. 10, MIC 1000 includes MOS sandwich capacitor 1030, replacing the feedback capacitor 931 in MIC 900 in FIG. 9. Feedback capacitor 931 is often large, for example, 100 pF-300 pF. According to an embodiment of the invention, the MOS sandwich capacitor used in MIC 1000 provides the desired capacitance, but requires a smaller device area.

Although the above has been shown using a selected group of components for the microphone interface circuit, there can be many alternatives, modifications, and variations. For example, some of the components may be expanded and/or combined. Other components may be inserted to those noted above. Depending upon the embodiment, the arrangement of components may be interchanged with others replaced. Further details of these components are found throughout the present specification.

Figure 11:
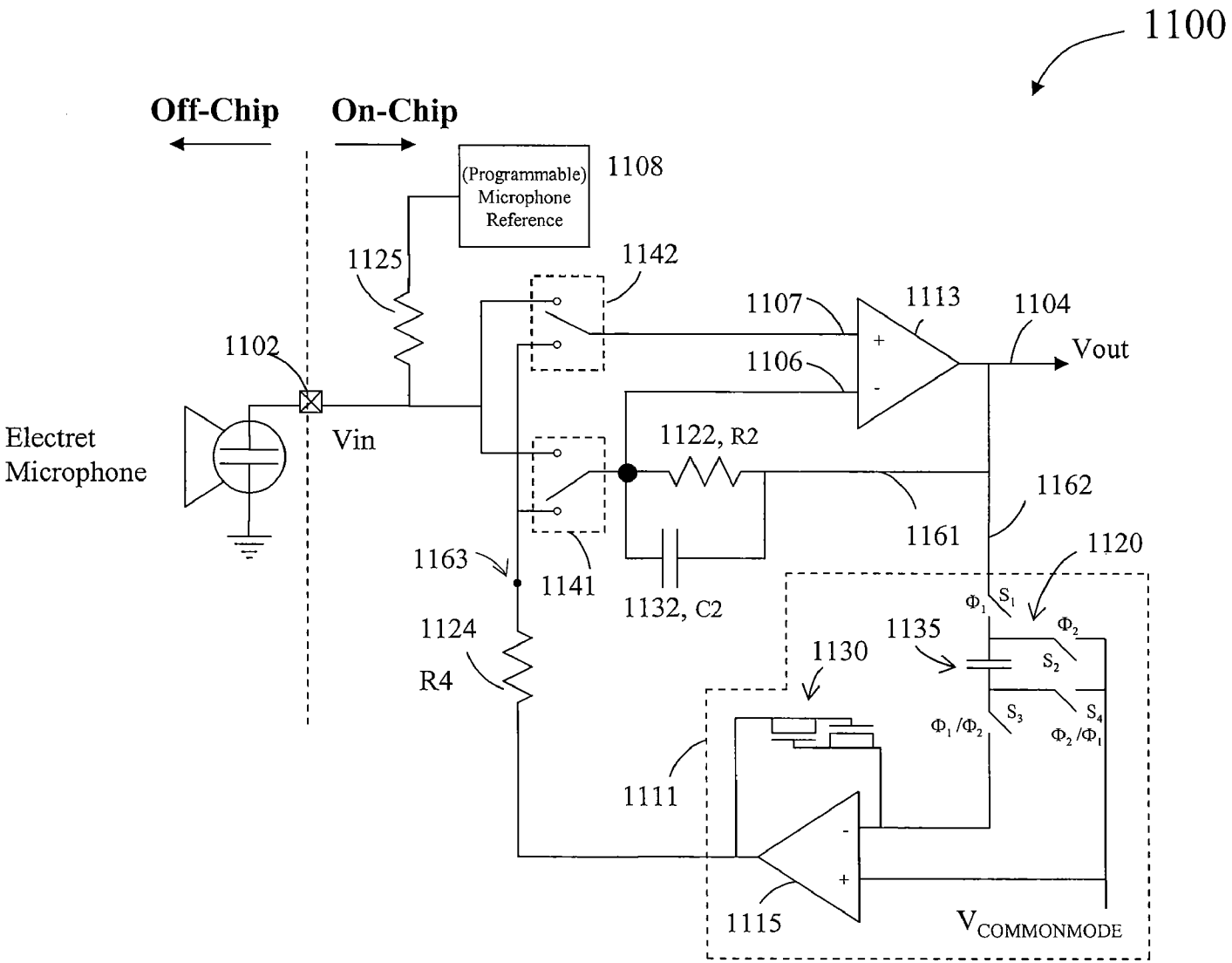
FIG. 11 is a simplified schematic diagram of an integrated circuit for a programmable microphone interface circuit according to an embodiment of the present invention.

FIG. 11 is a simplified schematic diagram of an integrated circuit for a programmable microphone interface according to an embodiment of the present invention. This diagram is merely an example, which should not unduly limit the scope of the claims herein. One of ordinary skill in the art would recognize other variations, modifications, and alternatives. As shown, MIC 1100 is an integrated circuit for providing a programmable microphone interface. MIC 1100 includes an input terminal 1102 for receiving an input signal Vin and an output terminal 1104 for providing an output audio signal Vout. MIC 1100 also includes a bias circuit in communication with the input terminal 1102. As shown, the bias circuit includes a microphone reference circuit 1108 and resistor 1125. In an embodiment, 1108 is a programmable reference circuit. Depending on the embodiment, microphone reference circuit 1108 can provide a reference voltage or a reference current. MIC 1100 includes a first amplifier circuit 1113, which including a first input 1106, a second input 1107, and an output coupled to the output terminal 1104. MIC 1100 further includes a first feedback circuit 1161 which includes resistor 1122 and capacitor 1132 connected in parallel. The first feedback circuit couples the output and the first input of amplifier 1113. MIC 1100 also includes a second feedback circuit 1162 which includes an integrator circuit 1111 and resistor 1124. The second feedback circuit 1162 provides a feedback signal at node 1163. In an embodiment, resistors 1122 and 1125 are programmable resistors.

As shown, integrator circuit 1111 includes an amplifier 1115, a switched capacitor circuit 1120, and a MOS sandwich capacitor 1130. The structure and function of integrator circuit 1111 are generally similar to those of integrators 1015 in FIG. 10 and integrator 815 in FIG. 8. The switched capacitor circuit 1120 and the MOS sandwich capacitor 1130 provide the desired resistance and capacitance and consume relative small device areas.

MIC 1100 also includes two switching devices responsive to two mode control signals. Switching device 1141 couples the first input 1106 of the first amplifier circuit to the input signal in response to a first mode control signal and couples the first input to the feedback signal at node 1163 in response to the second mode control signal. Switching device 1142 couples the second input 1107 of the first amplifier circuit to the feedback signal at node 1163 in response to the first mode control signal and couples the second input to the input signal in response to the second mode control signal. In an embodiment, the first and second mode control signals are derived from a mode control register (not shown).

It can be recognized that in the first operation mode (set by the first mode control signal) MIC 1100 is similar to MIC 800. In the second operation mode (set by the second mode control signal) MIC 1100 is similar to MIC 1000. Therefore, the operation of microphone interface circuit MIC 1100 is generally similar to that of MIC 800 or MIC 1000, depending upon the mode control signals. In particular, the switched capacitor circuit 1120 includes a second capacitor and a first, a second, a third, and a fourth switches. The first and second switches are coupled to a first terminal of the second capacitor 1135, whereas the third and fourth switches are couple to a second terminal of the second capacitor 1135. The second and fourth switches also coupled to the second reference voltage. Depending on the mode of operation, the switches are controlled by two programmable clock signals. In the first mode, the first and third switches are responsive to a first programmable clock signal, and the second and fourth switches are responsive to a second programmable clock signal. In the second mode, the first and fourth switches are responsive to a first programmable clock signal, and the second and third switches are responsive to a second programmable clock signal.

The feedback circuits in MIC 1100 provide high DC loop gain and low AC loop gain. More specifically, MIC 1100 is characterized by a large DC loop gain and low AC loop gain, causing the DC output voltage at the output terminal to be substantially equal to the second reference voltage; and the AC output voltage to be linearly proportional to the first feedback circuit's impedance and the AC input current or voltage through the input terminal. According to embodiments of the invention, MIC 1100 is capable of providing both the DC bias and the AC coupling in a single integrated circuit chip without the need for external components. In an embodiment, the circuit that provides the DC bias is independent of the feedback circuits. In addition, MIC 1100 can be programmed to operate in either operation modes.

Although the above has been shown using a selected group of components for the microphone interface circuit, there can be many alternatives, modifications, and variations. For example, some of the components may be expanded and/or combined. Other components may be inserted to those noted above. Depending upon the embodiment, the arrangement of components may be interchanged with others replaced. Further details of these components are found throughout the present specification.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. An integrated circuit for providing a microphone interface, the integrated circuit comprising:

an input terminal for receiving an input signal;

an output terminal for providing an output signal;

a bias circuit, the bias circuit being coupled to the input terminal for providing a bias signal at the input terminal, the bias circuit being configured to provide a sensed input signal;

a first amplifier circuit, the first amplifier circuit including a first input, a second input, and an output, the first input being configured to receive the sensed input signal, a first feedback signal, and a second feedback signal, the second input being configured to receive a first reference signal, the output being configured to provide the output signal to the output terminal;

a first feedback circuit, the first feedback circuit being in communication with the output and the first input of the first amplifier circuit, the first feedback circuit providing the first feedback signal to the first input of the first amplifier circuit; and a second feedback circuit, the second feedback circuit being in communication with the output and the first input of the first amplifier circuit, the second feedback circuit providing the second feedback signal to the first input of the first amplifier circuit, the second feedback circuit including an integrator circuit.

2. The integrated circuit of claim 1 wherein the input terminal is configured to receive an input signal from an electret microphone without requiring external components.

3. The integrated circuit of claim 1 wherein the bias circuit comprises:

a reference circuit for providing a second reference signal, the second reference signal including a reference voltage or a reference current;

a first input resistor in communication with the input terminal and the reference circuit; and a second input resistor in communication with the input terminal and the second input of the first amplifier circuit.

4. The integrated circuit of claim 1 wherein the first feedback circuit comprises a first feedback resistor and a first feedback capacitor in a parallel configuration.

5. The integrated circuit of claim 1 wherein the integrator circuit comprises:

an inverting amplifier coupled to the output of the first amplifier circuit;

a second amplifier circuit, the second amplifier circuit including a first input, a second input, and an output, the second input being coupled to a third reference signal;

a second feedback resistor coupled to an output of the unity gain inverting amplifier and the first input of the second amplifier circuit; and a second feedback capacitor coupled to the first input and the output of the second amplifier circuit;

wherein the output of the second amplifier circuit is coupled to the second input of the first amplifier circuit through a third feedback resistor.

6. The integrated circuit of claim 1 wherein the integrator circuit comprises:

a switched capacitor circuit, the switched capacitor circuit including a switch capacitor and a first, a second, a third, and a fourth switches, the first and second switches being coupled to a first terminal of the switch capacitor, the third and fourth switches being couple to a second terminal of the switch capacitor, the second and fourth switches being coupled to the first reference signal;

a second amplifier circuit, the second amplifier circuit including a first input, a second input, and an output, the first input being in communication with the third switch of the switched capacitor circuit, the second input being coupled to the first reference signal; and a second feedback capacitor in communication with the first input and the output of the second amplifier circuit.

7. The integrated circuit of claim 1 further comprising a supply voltage, wherein the first reference signal is about half of the supply voltage in magnitude for providing maximum signal swing allowed by the supply voltage at the output terminal.

8. The integrated circuit of claim 1 wherein the integrated circuit is characterized by a DC loop gain, the DC loop gain being sufficiently large to cause a voltage at the output of the first amplifier to be substantially equal to the first reference signal.

9. The integrated circuit of claim 8 wherein the integrated microphone interface circuit is characterized by a DC loop gain ranging from about 80 dB to about 140 dB.

10. The integrated circuit of claim 1 wherein the integrated circuit is characterized by a large DC loop gain and low AC loop gain, causing a DC output voltage at the output terminal to be substantially equal to the first reference signal, and an AC output voltage to be linearly proportional to the first feedback circuit's impedance and an AC input current or voltage through the input terminal.

11. An integrated circuit for providing a microphone interface, the integrated circuit comprising:

an input terminal for receiving an input signal;

an output terminal for providing an output signal;

a programmable reference circuit coupled to the input terminal for providing a bias signal;

a first amplifier circuit, the first amplifier circuit including a first input, a second input, and an output, the first input being configured to receive the bias signal, a first feedback signal, and a second feedback signal, the second input being configured to receive a first reference signal, the output being configured to provide the output signal to the output terminal;

a first feedback circuit, the first feedback circuit being in communication with the output and the first input of the first amplifier circuit, the first feedback circuit providing the first feedback signal to the first input of the first amplifier circuit; and a second feedback circuit, the second feedback circuit being in communication with the output and the first input of the first amplifier circuit, the second feedback circuit providing the second feedback signal to the first input of the first amplifier circuit, the second feedback circuit including an integrator circuit.

12. The integrated circuit of claim 11 wherein the input terminal is configured to receive an input signal from an electret microphone without requiring external components.

13. The integrated circuit of claim 11 wherein the bias circuit comprises:

a reference circuit for providing a second reference signal, the second reference signal being a reference voltage or a reference current;

a first input resistor in communication with the input terminal and the reference circuit; and a second input resistor in communication with the input terminal and the second input of the first amplifier circuit.

14. The integrated circuit of claim 11 wherein the first feedback circuit comprises a first feedback resistor and a first feedback capacitor in a parallel configuration.

15. The integrated circuit of claim 11 wherein the integrator circuit comprises:

an inverting amplifier coupled to the output of the first amplifier circuit;

a second amplifier circuit, the second amplifier circuit including a first input, a second input, and an output, the second input being coupled to a third reference signal;

a second feedback resistor coupled to an output of the unity gain inverting amplifier and the first input of the second amplifier circuit; and a second feedback capacitor coupled to the first input and the output of the second amplifier circuit;

wherein the output of the second amplifier circuit is coupled to the second input of the first amplifier circuit through a third feedback resistor.

16. The integrated circuit of claim 11 wherein the integrator circuit comprises:

a switched capacitor circuit, the switched capacitor circuit including a switch capacitor and a first, a second, a third, and a fourth switches, the first and second switches being coupled to a first terminal of the switch capacitor, the third and fourth switches being couple to a second terminal of the switch capacitor, the second and fourth switches being coupled to the first reference signal;

a second amplifier circuit, the second amplifier circuit including a first input, a second input, and an output, the first input being in communication with the third switch of the switched capacitor circuit, the second input being coupled to the first reference signal; and a second feedback capacitor in communication with the first input and the output of the second amplifier circuit.

17. The integrated circuit of claim 11 wherein the integrated circuit is characterized by a DC loop gain, the DC loop gain being sufficiently large to cause a voltage at the output of the first amplifier to be substantially equal to the first reference signal.

18. The integrated circuit of claim 11 wherein the integrated microphone interface circuit is characterized by a DC loop gain ranging from about 80 dB to about 140 dB.

19. The integrated circuit of claim 11 wherein the integrated circuit is characterized by a large DC loop gain and low AC loop gain, causing a DC output voltage at the output terminal to be substantially equal to the first reference signal, and an AC output voltage to be linearly proportional to the first feedback circuit's impedance and an AC input current or voltage through the input terminal.

* * * * *